US010772432B2

(12) United States Patent
Park

(10) Patent No.: US 10,772,432 B2
(45) Date of Patent: Sep. 15, 2020

(54) FOOT AND LEG SUPPORT DEVICE FOR A CHAIR

(71) Applicant: BRIGHT COMPANY INC., Toronto (CA)

(72) Inventor: Ae-Kyung Daphne Park, Toronto (CA)

(73) Assignee: Bright Company Inc., Toronto, Ontario (CA)

( * ) Notice: Subject to any disclaimer, the term of this patent is extended or adjusted under 35 U.S.C. 154(b) by 0 days.

(21) Appl. No.: 16/320,271

(22) PCT Filed: Mar. 21, 2017

(86) PCT No.: PCT/CA2017/050355
§ 371 (c)(1),
(2) Date: Jan. 24, 2019

(87) PCT Pub. No.: WO2018/018130
PCT Pub. Date: Feb. 1, 2018

(65) Prior Publication Data

US 2019/0231077 A1 Aug. 1, 2019

Related U.S. Application Data

(63) Continuation-in-part of application No. 15/222,360, filed on Jul. 28, 2016, now Pat. No. 9,642,465.

(51) Int. Cl.
*A47C 7/50* (2006.01)
*A47C 7/52* (2006.01)
*A47C 7/00* (2006.01)

(52) U.S. Cl.
CPC ..... *A47C 7/506* (2013.01); *A47C 7/004* (2013.01); *A47C 7/5062* (2018.08);
(Continued)

(58) Field of Classification Search
CPC ..... A47C 7/506; A47C 7/5064; A47C 7/5066
See application file for complete search history.

(56) References Cited

U.S. PATENT DOCUMENTS 388,981 A 9/1888 La Barbe
1,854,478 A 4/1932 Meyers
(Continued)

FOREIGN PATENT DOCUMENTS

CN 103892600 7/2014
JP 2007181614 7/2007

OTHER PUBLICATIONS

International Search Report & Written Opinion dated Jun. 28, 2017 for PCT/CA2017/050355.

*Primary Examiner* — Timothy J Brindley
(74) *Attorney, Agent, or Firm* — Ridout & Maybee LLP

(57) ABSTRACT

A foot and/or leg support device for a chair, the chair including a central post having a base, a seat supported by the central post, and a plurality of support legs which branch from the base of the central post. In an example, the support device includes: a connector for attachment to the central post of the chair, wherein the connector comprises a circular interior having a radius of curvature substantially equal to a radius of the central post of the chair; a cantilever arm which extends from the connector; a pivot which connects the cantilever arm to the connector, the pivot being configured for vertical pivoting; and a support frame located at a distal end of the cantilever arm for supporting a foot and/or leg of a user.

22 Claims, 34 Drawing Sheets

(52) U.S. Cl.
CPC ..... *A47C 7/5064* (2018.08); *A47C 7/5066* (2018.08); *A47C 7/52* (2013.01)

(56) References Cited

U.S. PATENT DOCUMENTS

| | | | | | |
|---|---|---|---|---|---|
| 2,524,187 | A | | 10/1950 | Boles | |
| 2,546,460 | A | | 3/1951 | Leeds | |
| 3,458,234 | A | | 7/1969 | Bates | |
| 3,820,844 | A | | 6/1974 | Fortnam | |
| 3,961,822 | A | * | 6/1976 | Daniel | A47C 16/025 297/423.1 |
| 4,765,684 | A | * | 8/1988 | Kvalheim | A47C 9/005 297/313 |
| 4,767,159 | A | | 8/1988 | Opsvik | |
| 5,152,581 | A | * | 10/1992 | Norsworthy | A47C 7/506 248/188.9 |
| 5,174,631 | A | | 12/1992 | Schaevitz | |
| D336,791 | S | * | 6/1993 | Stidd | D12/318 |
| 5,255,957 | A | * | 10/1993 | Opsvik | A47C 9/005 297/423.12 |
| 6,149,238 | A | | 11/2000 | Markussen | |
| 6,149,239 | A | * | 11/2000 | Markussen | A47C 7/52 248/123.11 |
| 6,607,246 | B1 | | 8/2003 | Benden | |
| 6,648,417 | B1 | | 11/2003 | Gilbert et al. | |
| 6,695,407 | B1 | | 2/2004 | Lin | |
| 7,032,976 | B2 | | 4/2006 | Lin | |
| 7,036,886 | B2 | * | 5/2006 | Benden | A47C 7/004 297/423.21 |
| 7,387,343 | B1 | | 6/2008 | Hsieh | |
| 7,452,034 | B2 | | 11/2008 | Jung | |
| 8,246,118 | B2 | | 8/2012 | Moore | |
| 9,220,346 | B1 | | 12/2015 | Wu | |
| 2005/0189808 | A1 | | 9/2005 | Lin | |
| 2005/0253441 | A1 | | 11/2005 | Benden et al. | |
| 2006/0102816 | A1 | | 5/2006 | Zhang | |
| 2006/0152061 | A1 | | 7/2006 | Wu | |
| 2006/0175518 | A1 | | 8/2006 | Hu | |
| 2007/0063569 | A1 | * | 3/2007 | Mays | A47C 9/005 297/423.12 |
| 2007/0290541 | A1 | | 12/2007 | Tsai | |
| 2008/0185896 | A1 | | 8/2008 | Wei | |
| 2011/0226925 | A1 | | 9/2011 | Tsai | |
| 2012/0086257 | A1 | | 4/2012 | Wald | |
| 2014/0070592 | A1 | | 3/2014 | Yeh | |
| 2014/0077575 | A1 | | 3/2014 | Hsieh | |
| 2014/0265512 | A1 | | 9/2014 | Pritchard | |
| 2015/0137575 | A1 | | 5/2015 | Millasseau | |
| 2015/0335159 | A1 | * | 11/2015 | Kieryllo | A47C 9/005 297/283.1 |
| 2016/0095444 | A1 | | 4/2016 | Gredinger | |
| 2019/0269248 | A1 | * | 9/2019 | Beloff | A47C 7/52 |

* cited by examiner

FOOT AND LEG SUPPORT DEVICE FOR A CHAIR

CROSS-REFERENCE TO RELATED APPLICATION(S)

This application is a U.S. nationalization under 35 U.S.C. § 371 of International Application No. PCT/CA2017/050355 filed Mar. 21, 2017 entitled FOOT AND LEG SUPPORT DEVICE FOR A CHAIR, which is a Continuation-In-Part of U.S. patent application Ser. No. 15/222,360 filed Jul. 28, 2016 entitled FOOT AND LEG SUPPORT DEVICE FOR A CHAIR, all the contents of which are herein incorporated by reference into the below DETAILED DESCRIPTION OF EXAMPLE EMBODIMENTS.

TECHNICAL FIELD

Example embodiments generally relate to furniture, for example chairs and footrests.

BACKGROUND

A chair is a common piece of furniture used alone or with any desk or table, for example in an office or a boardroom. With much time spent sitting on a chair, it is important to create a seating position that supports the body, more specifically the feet and legs, and is ergonomically designed for long term comfort. Without proper support, a user can sustain periods of poor posture leading to stiffness, pain or fatigue. Moreover, confining the feet and legs to one position for an extended time may encourage poor circulation of blood flow in the legs and feet which can cause swollen ankles and blood clots. Overall, an incorrect sitting posture can be a threat to a user's health.

Some footrests are used to enhance support of the feet. However, many of these footrests may not sufficiently provide adequate feet and/or leg comfort for users of varying sizes, including adults of shorter stature and children.

One type of device for supporting the feet while in a seated position is with a metal ring or circular apparatus secured either to the post or to the horizontal legs of the chair. However, these circular supports are either fixed such that the footrest is set at a specific height typically at the base of the chair, and/or at a specific diameter, whereby the possible feet positions and leg angles are restrictive and dependent on the size of the user.

Additional difficulties with existing systems may be appreciated in view of the Detailed Description of Example Embodiments, herein below.

SUMMARY

Example embodiments generally relate to furniture, for example chairs and footrests. Example embodiments generally relate to an elevated, adjustable, rotational, and extendable foot and/or leg support device which can be removably mounted to a post of a chair.

In an example embodiment, there is provided a foot and/or leg support device for a chair, the chair including a central post having a base, a seat supported by the central post, and a plurality of support legs which branch from the base of the central post. The support device includes: a connector for attachment to the central post of the chair, wherein the connector comprises a circular interior having a radius of curvature substantially equal to a radius of the central post of the chair; a cantilever arm which extends from the connector; a pivot which connects the cantilever arm to the connector, the pivot being configured for vertical pivoting; and a support frame located at a distal end of the cantilever arm for supporting a foot and/or leg of a user.

In an example embodiment, there is provided a foot and/or leg support device for a chair, the chair including a central post having a base, a seat supported by the central post and having a front seat edge, and a plurality of support legs which branch from the base of the central post. The support device includes: a clamp for attachment to the central post of the chair, mountable to different diameters of the central post, and installed at a tightness which permits rotational movement around the central post, the clamp being supported against vertical loads by at least one or both of the base of the central post or a second clamp that is tightened around the central post; a cantilever arm which extends from the clamp; and a support frame located at a distal end of the cantilever arm for supporting a foot and/or leg of a user, the cantilever arm being a length wherein at least part of the support frame extends past a vertical plane of the front seat edge of the chair.

In an example embodiment, the support device can be installed onto the central post of the chair without disassembling the chair. In an example embodiment, the support device can be in an extended configuration to adjust for various lengths. In an example embodiment, the support device can be mounted at different vertical heights or vertical angle adjustable so that the support frame is at different vertical heights. In an example embodiment, the support device can be retracted and/or pivoted away when not in use.

BRIEF DESCRIPTION OF THE DRAWINGS

Reference will now be made, by way of example, to the accompanying drawings which show example embodiments, and in which.

Similar reference numerals may have been used in different figures to denote similar components.

DETAILED DESCRIPTION OF EXAMPLE EMBODIMENTS

Example embodiments generally relate to an adjustable, rotational and extendable foot and/or leg support device which can be mounted to a post of a chair.

An example embodiment is a foot and/or leg support device for a chair such as a task chair. The chair includes a central post having a base, a seat supported by the central post and having a front seat edge, and a plurality of support legs which branch from the base of the central post. The support device includes a connector for attachment to the central post of the chair, wherein the connector comprises a circular interior having a radius of curvature substantially equal to a radius of the central post of the chair; a cantilever arm which extends from the connector; a pivot which connects the cantilever arm to the connector, the pivot being configured for vertical pivoting; and a support frame located at a distal end of the cantilever arm for supporting a foot and/or leg of a user.

Another example embodiment is a foot and/or leg support device for a chair such as a task chair. The chair includes a central post having a base, a seat supported by the central post and having a front seat edge, and a plurality of support legs which branch from the base of the central post. The support device includes: a clamp for attachment to the central post of the chair, mountable to different diameters of the central post, and installed at a tightness which permits rotational movement around the central post, the clamp being supported against vertical loads by at least one or both of the base of the central post or a second clamp that is tightened around the central post; a cantilever arm which extends from the clamp; and a support frame located at a distal end of the cantilever arm for supporting a foot and/or leg of a user, the cantilever arm being a length wherein at least part of the support frame extends past a vertical plane of the front seat edge of the chair.

Figure 1:
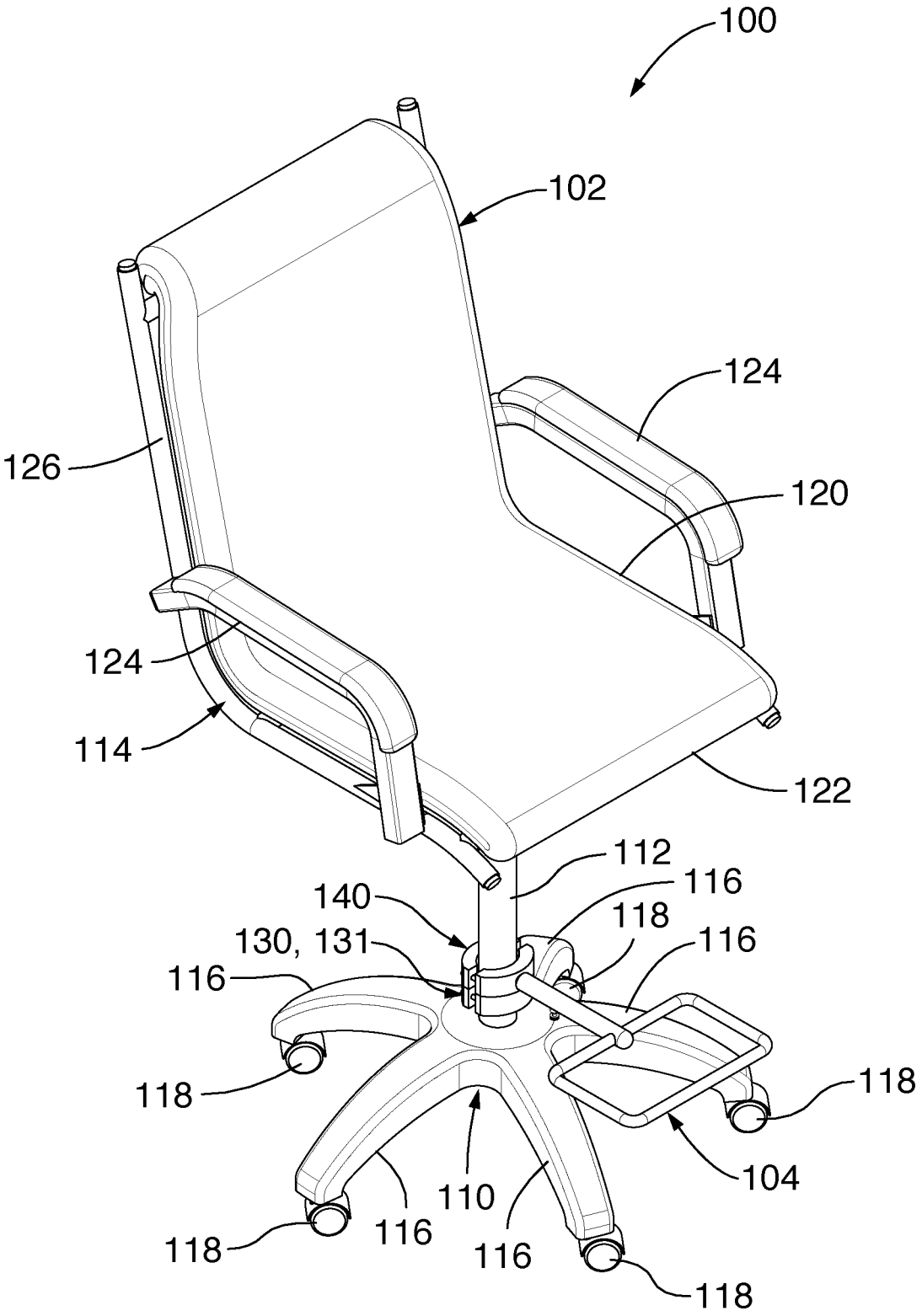
FIG. 1 illustrates a top-front perspective view of a foot and/or leg support system, including a chair and a foot and/or leg support device, in accordance with an example embodiment.

Reference is first made to FIG. 1, which illustrates a foot and/or leg support system 100, including a chair 102 and a foot and/or leg support device 104, in accordance with an example embodiment. Generally, the support device 104 can be used to support the feet and/or legs of the user when seated on the chair 102. The support device 104 can be removably clamped to various post sizes of the chair 102, and at various heights, for example. Further, for example, the support device 104 may be used by users of varying sizes and in different positions, for example providing flexibility of use and comfort to the general user. In some example embodiments, users of shorter stature or children may especially benefit.

As shown in FIG. 1, in an example embodiment, the chair 102 can be a task chair or office chair. As shown in FIG. 1, the chair 102 includes a base 110, a central post 112, and a chair body 114. The support device 104 can be removably clamped to the post 112 without disassembling the chair 102, for example. In some example embodiments, the system 100 is adjustable in that it may be used for different sizes of the central post 112, and may be adjusted horizontally and vertically. In an example embodiment, an extension mechanism can be used to provide horizontal extension of the support device 104, as described in greater detail herein. In an example embodiment, a spacer 130 can be positioned between the support device 104 and the base 110, to provide vertical adjustment. The spacer 130 can also sometimes be referred to as a bumper.

Referring to the chair 102, the base 110 includes a plurality of support legs 116 (five shown) which branch out from a connection point at the base 110 of the central post 112. Each support leg 116 can include a respective wheel 118. Each wheel 118 may, for example, be mounted to the corresponding support leg 116 using castors, axles, pivots, etc., as applicable. The distal end of the support legs 116 can collectively define a circumference or circumferential reference.

As shown in FIG. 1, the chair body 114 can include a seat 120 which is supported by the central post 112. The seat 120 has a front seat edge 122. The chair body 114 can also include, for example, arm rests 124 and a seat back 126. In some examples, the chair body 114 can comprise a cushion or other ergonomic materials such as nylon mesh. Other types of chairs may be used in other example embodiments, depending on the particular application. In an example embodiment, the chair 102 can include a seat 120 but no back or armrests, for example. In an example embodiment, the chair 102 can include more or less than five support legs 116. In an example embodiment, the chair 102 includes support legs 116 without wheels.

Reference is now made to FIGS. 1 to 12, which illustrate the support device 104 in greater detail. In FIGS. 2 to 12, aspects of the chair 102 such as the chair body 114 are not illustrated for clarity and for convenience of illustration. The support device 104 includes a connector such as a clamp 140 for clamping onto the central post 112, a cantilever arm 142 having a proximal end connected to the clamp 140, and a support frame 144 mounted to a distal end of the arm 142. The support frame 144 is for supporting the legs and/or feet of the user when sitting on the chair 102, for example.

The cantilever arm 142 is a cantilever, which is understood in the art as being attached at only the proximal end of the arm 142 to the clamp 140 and mounted to post 112, and the distal end of the arm 142 is freely protruding. In an example embodiment, only exactly one cantilever arm 142 is used. As shown, the cantilever arm 142 can have a tubular cross-section. Other example cross-sections of the arm 142 can include, for example, truss (triangle) cross-section, rectangular cross-section, oval cross-section, hourglass cross-section, or I-beam cross-section.

Figure 8:
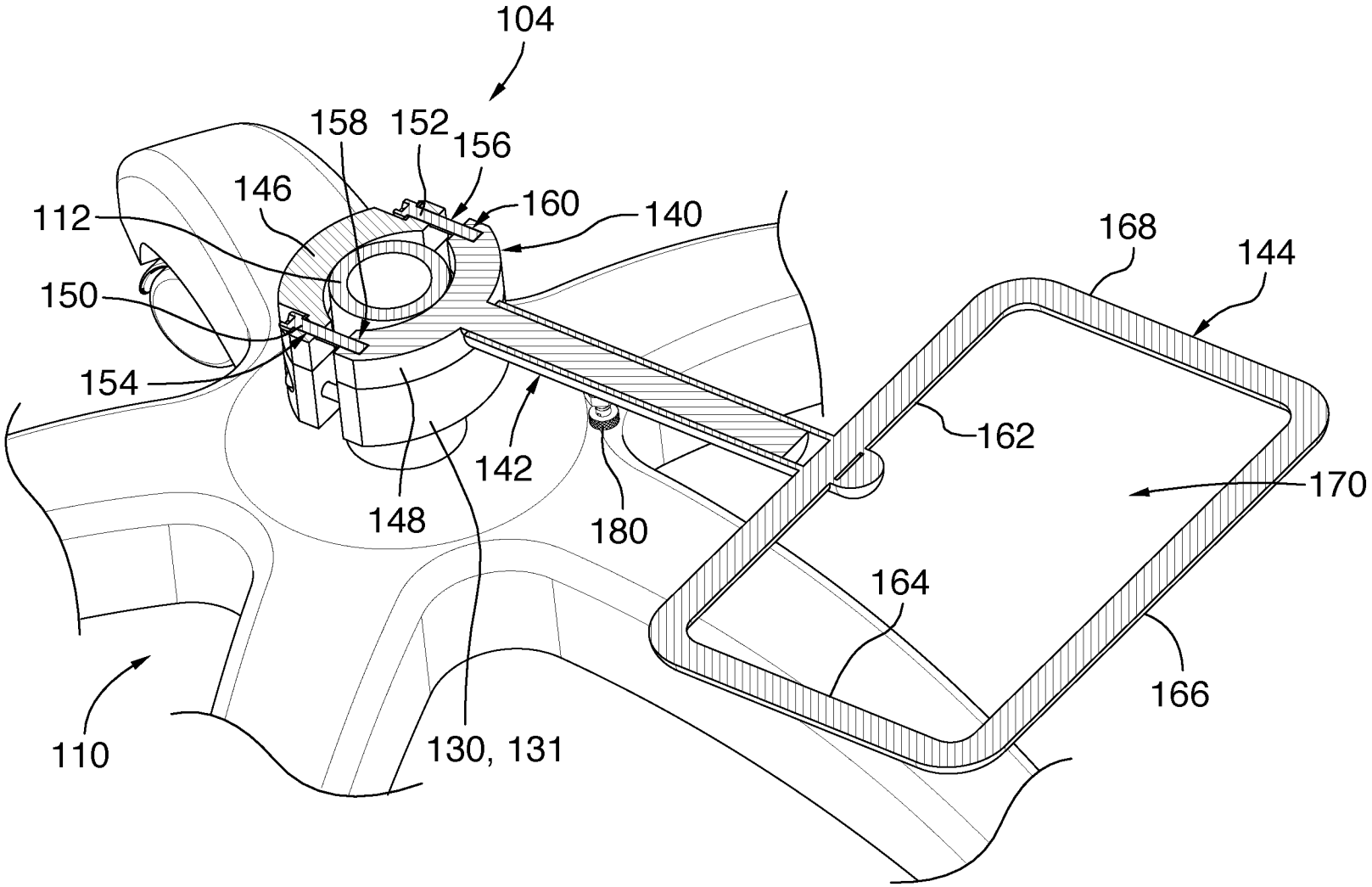
FIG. 8 illustrates a detail sectional top-front perspective view of the foot and/or leg support device shown in FIG. 1.
Figure 9:
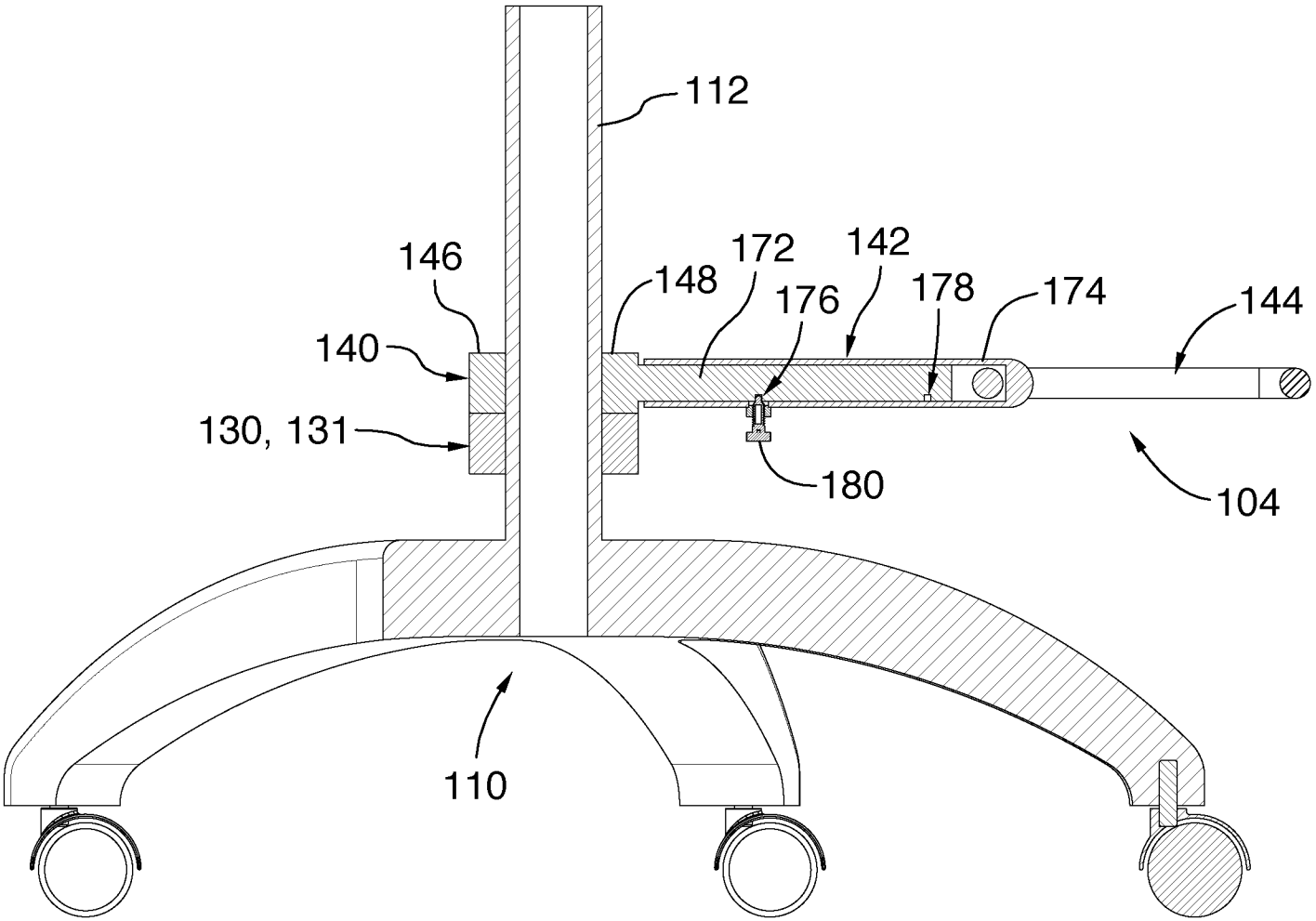
FIG. 9 illustrates a detail side sectional view of the foot and/or leg support device shown in FIG. 1 in the retracted configuration.
Figure 10:
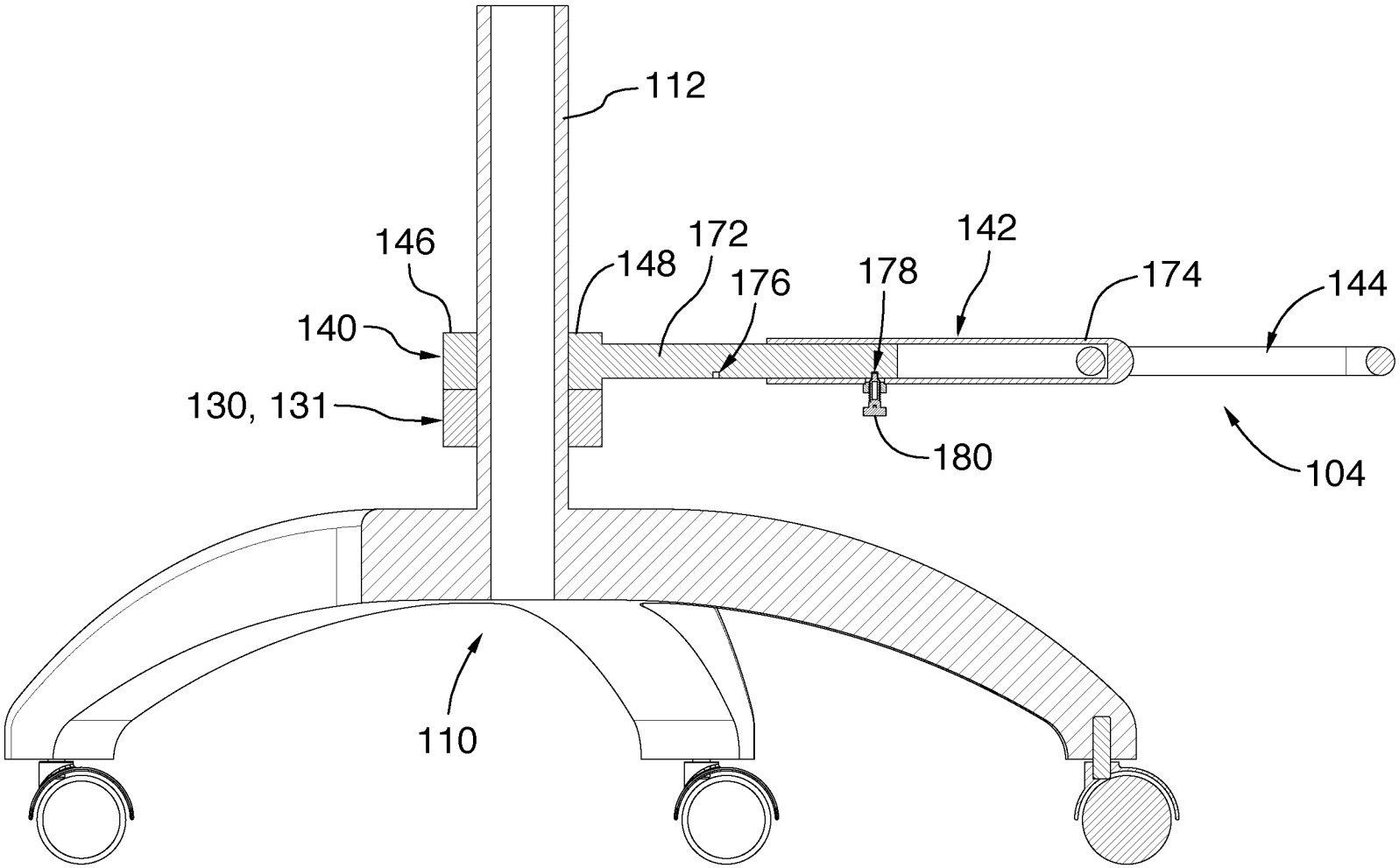
FIG. 10 illustrates the view of FIG. 9 in the extended configuration.
Figure 11:
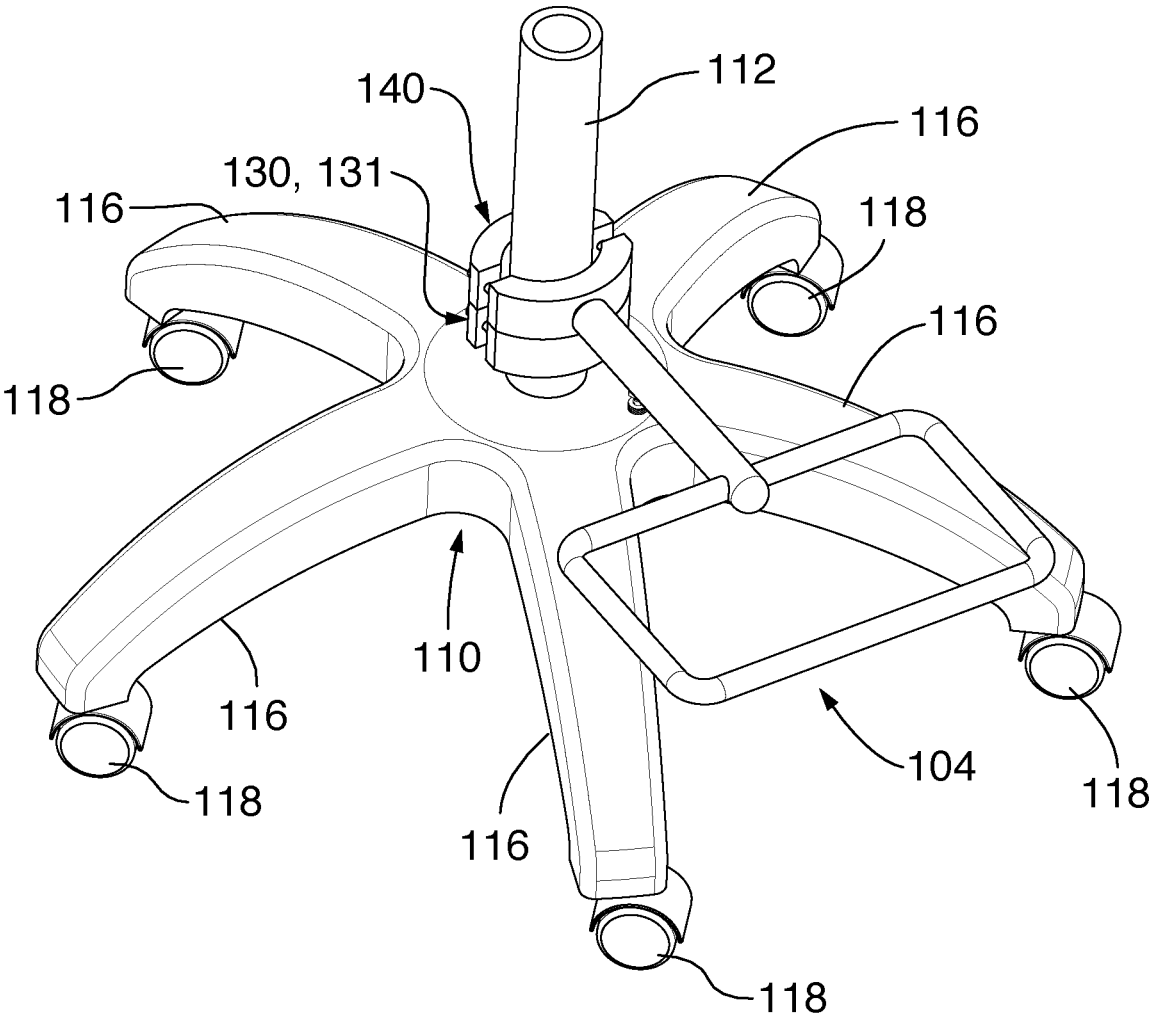
FIG. 11 illustrates a detail top-front perspective view of the foot and/or leg support device shown in FIG. 1.
Figure 12:
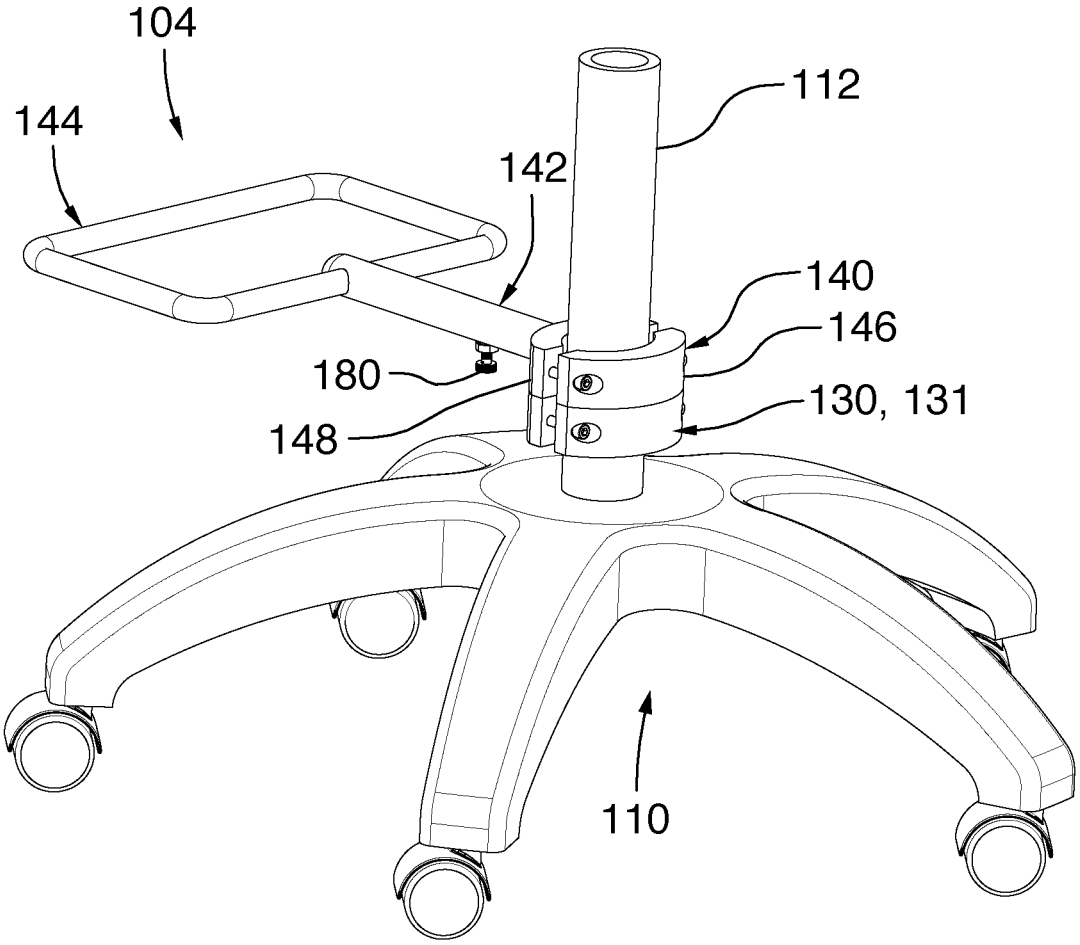
FIG. 12 illustrates a detail top-rear perspective view of the foot and/or leg support device shown in FIG. 1.

Reference is now made to FIG. 8, which illustrates the clamp 140 of the support device 104 in greater detail, in accordance with an example embodiment. The clamp 140 has flexibility in use in that it can be used to clamp onto various sizes of the central post 112. As shown in FIG. 8, the clamp 140 includes a first clamp part 146 and a second clamp part 148. The proximal end of the arm 142 is mounted to the second clamp part 148. Each clamp part 146, 148 comprises an inner radius which is shaped as an arc in order to fit around the central post 112 of the chair 102. As shown in FIG. 8, in an example embodiment, the clamp parts 146, 148 are each shaped as an arc of less than 180 degrees and having a radius of curvature of a same circle. In an example embodiment, the arcs can each be on or about 120 degrees.

Still referring to FIG. 8, the clamp 140 further includes a first fastener such as a first bolt 150 for connecting the first clamp part 146 and the second clamp part 148 at one side of the central post 112. The clamp 140 includes a second fastener such as a second bolt 152 for connecting the first clamp part 146 and the second clamp part 148 at an opposite side of the central post 112. Each bolt 150, 152 includes a head shaped for receiving a rotary tool such as a Phillips head, Allen key or other suitable shapes. Each bolt 150, 152 includes a shaft body that includes screw threads. In an example embodiment, a respective washer (not shown) can be used at the head of each bolt 150, 152 to maintain the tightness of the bolt 150, 152.

The first clamp part 146 can define channels 154, 156 for receiving of the respective bolts 150, 152. The channels 154, 156 may be smooth in some example embodiments, or may contain screw threads in other example embodiments.

The second clamp part 148 can define screw holes 158, 160 for receiving of the respective bolts 150, 152. The screw holes 158, 160 contain screw threads to receive the shaft body of the respective bolts 150, 152. For example, a separate nut may not be required for the bolts 150, 152, in such an embodiment.

In an example embodiment, the clamp 140 is flexible in use in that it can be used to clamp onto various sizes of the central post 112. For example, as shown in FIG. 8, the first bolt 150 and the second bolt 152 are exposed when the clamp is securely fastened to the central post 112 of the radius shown. For a central post 112 of a smaller radius, the bolts 150, 152 can be tightened so that the first and second clamp parts 146, 148 are closer to each other. For even smaller central posts 112, the first and second clamp parts 146, 148 can be tightened until such position that the first and second clamp parts 146, 148 mate and the bolts 150, 152 are no longer exposed, representing a minimum possible radius of the central post 112. Similarly, the bolts 150, 152 can be at a looser setting when clamping onto a central post 112 having a larger radius. Further, some chairs 102 can have different radiuses along the central post 112, for example for some chairs 102 that have an adjustable height.

In an example embodiment, the radius of curvature of the first and second clamp parts 146, 148 is at least twice a radius of the central post 112, for example.

The tightness of the clamp 140 can be adjusted based on the particular application. For example, full tightness of the clamp 140 can be implemented when it is desired that the clamp 140 does not rotate around the central post 112. In an example embodiment, less than full tightness can be implemented so that the clamp 140, and consequently the support frame 144, can be rotated about the central post 112 when installed, while still suitably tight enough to support load from the feet and/or legs of the user. For example, the support frame 144 can be rotated away to a rear position when not in use, or into a frontal position when desired to be used. The clamp 140 can be adjusted vertically based on use of one or more spacer(s) 130. The clamp 140 can have its vertical load supported by the one or more spacer(s) 130, which can be positioned just below the clamp 140 and wherein the one or more spacer(s) 130 are secured as tight as possible, while the clamp 140 can be slightly looser than full tightness to support the weight of the user on the support frame 144 while still permitting 360 rotational horizontal movement, when installed.

In an example embodiment, the clamp 140 is maintained in relative vertical placement on the central post 112 by placing directly on top of the base 110 of the chair. For example, the base 110 of the chair 102 may be sufficiently high to provide vertical height and support against the vertical load of the clamp 140. In an example embodiment, some chairs 102 can have different radiuses along the central post 112, and the clamp 140 can be installed on one of the smaller radiuses and vertically supported by one of the larger radiuses located just below where the clamp 140 is attached.

In an example embodiment, an interior facing of the clamp 140 can include a friction reducing coating or material to facilitate the 360 rotational movement when installed.

The support frame 144 will now be described in greater detail, as best shown in FIGS. 2 to 5 and 11 to 12. The support frame 144 provides a structure for resting of the legs and/or feet of the user when sitting on the chair 102, for example. As shown, the support frame 144 comprises a perimeter of a shape, such as a rounded rectangular. The perimeter is therefore open or unfilled. The perimeter can include frame members 162, 164, 166, 168 which are tubes or rods, and in an example embodiment, each being 1.27 centimeters (0.5 inches) in diameter. One frame member 162 is mounted to the cantilever arm 142.

In an example embodiment, the perimeter of the support frame 144 can have a transverse width of about 28 centimeters (11 inches), e.g. for the length of frame members 162, 166. In an example embodiment, the support frame 144 can have a length of about 20.3 centimeters (8 inches), e.g. for the length of frame members 164, 168. In an example embodiment, the cantilever arm 142 can have a length that is on or about 25.4 centimeters (10 inches) in the retracted configuration and 38.1 cm (15 inches) in extended configuration.

The perimeter of the support frame 144 defines an aperture 170 which is the entire space within the perimeter. For example, this requires less material to be used. As well, the aperture 170 can be used for receiving one or both shoes or a part of the shoe such as heels or high-heels. Any part of the support frame 144 can be used as a foot rest for shorter individuals, while the distal frame member 166 can be used as a foot rest for relatively taller individuals. The distal frame member 166 may be used as a leg rest, approximately around the ankle, calf or hamstring area when the individual's legs are extended.

Figure 2:
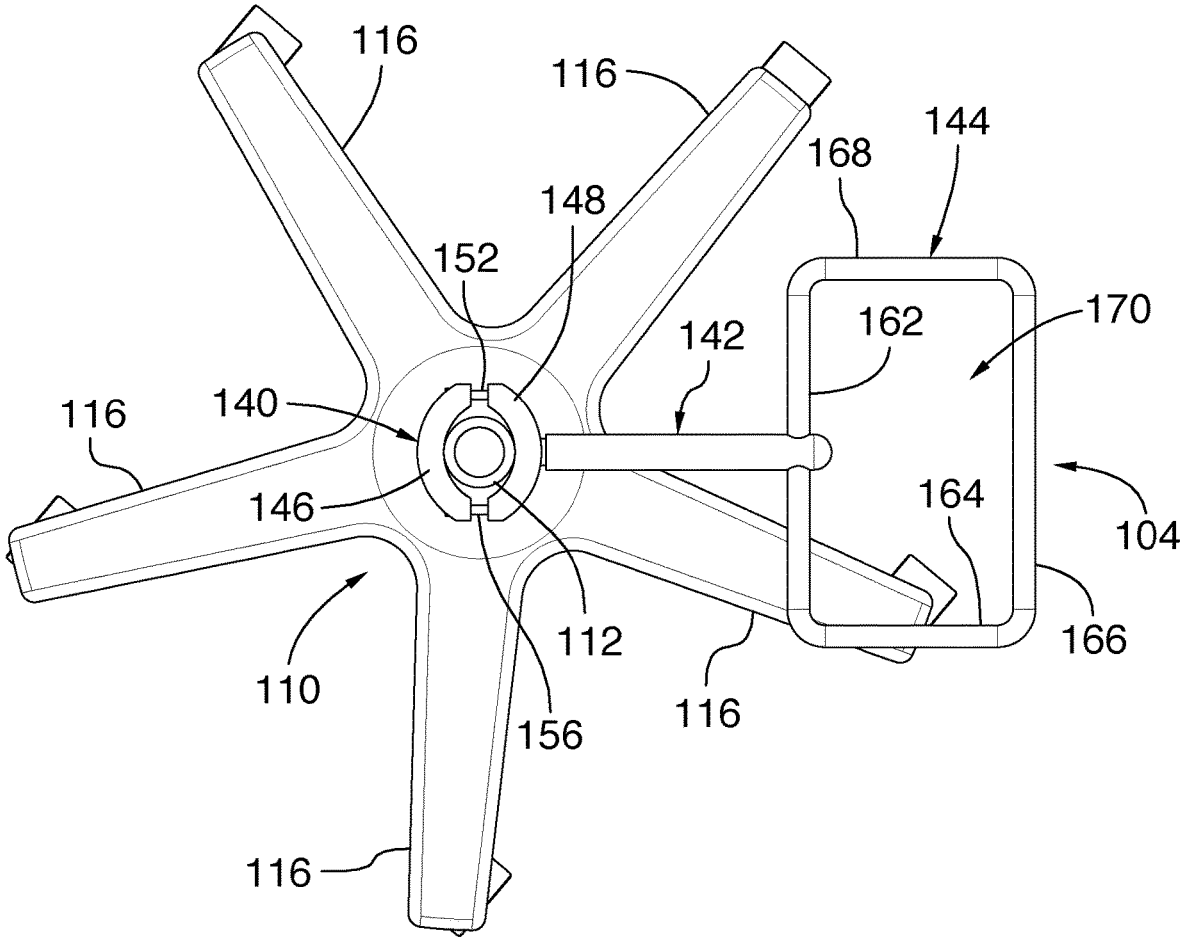
FIG. 2 illustrates a detail top view of the foot and/or leg support device shown in FIG. 1.

In another example embodiment, not shown, the frame members 162, 164, 166, 168 are shaped as flat strips, and in an example embodiment, each being about 1.27 centimeters (0.5 inches) in width and about 1.9 centimeters (0.75) inches thick, and having the same lengths as shown in FIG. 2. In another example embodiment, the frame members 162, 164, 166, 168 have a tubular cross-section. Other shapes of cross-section may be used in other example embodiments.

In another example embodiment, the perimeter of the support frame 144 is filled in or solid, without the aperture 170.

Referring to FIG. 1, in an example embodiment, an extension mechanism can be used to further extend the support frame 144 from the clamp 140 to an extended configuration, or can be retracted to a retracted configuration.

Figure 3:
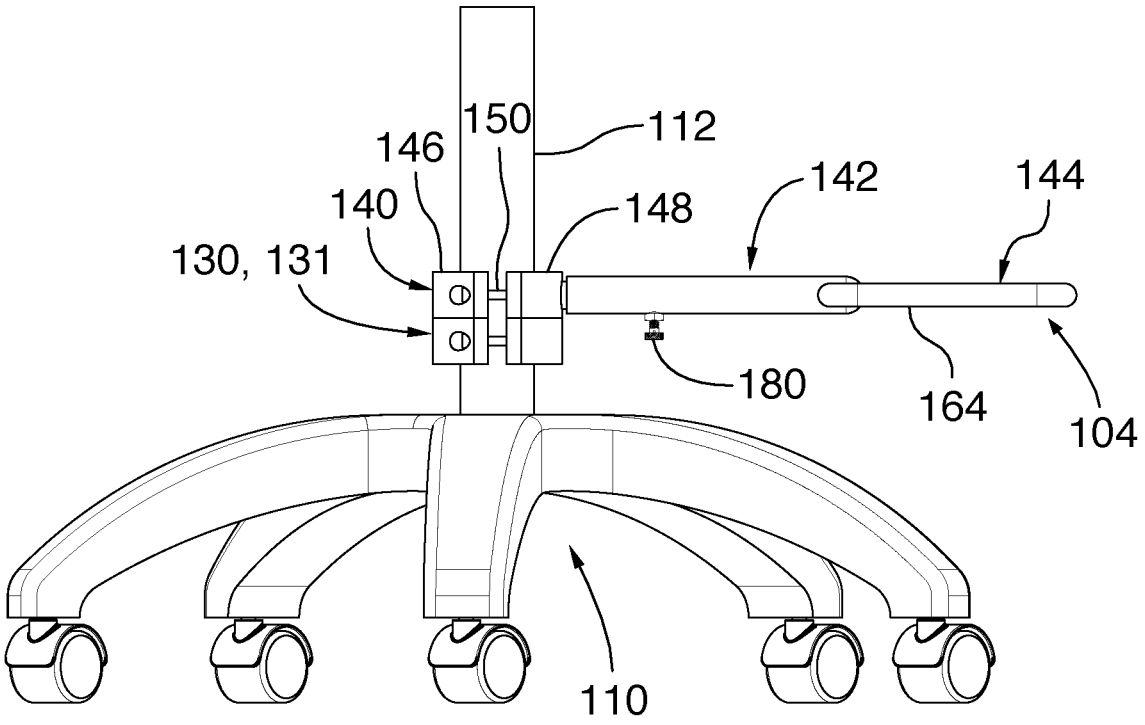
FIG. 3 illustrates a detail left side view of the foot and/or leg support device shown in FIG. 1, the right side view being substantially a mirror image thereof.
Figure 4:
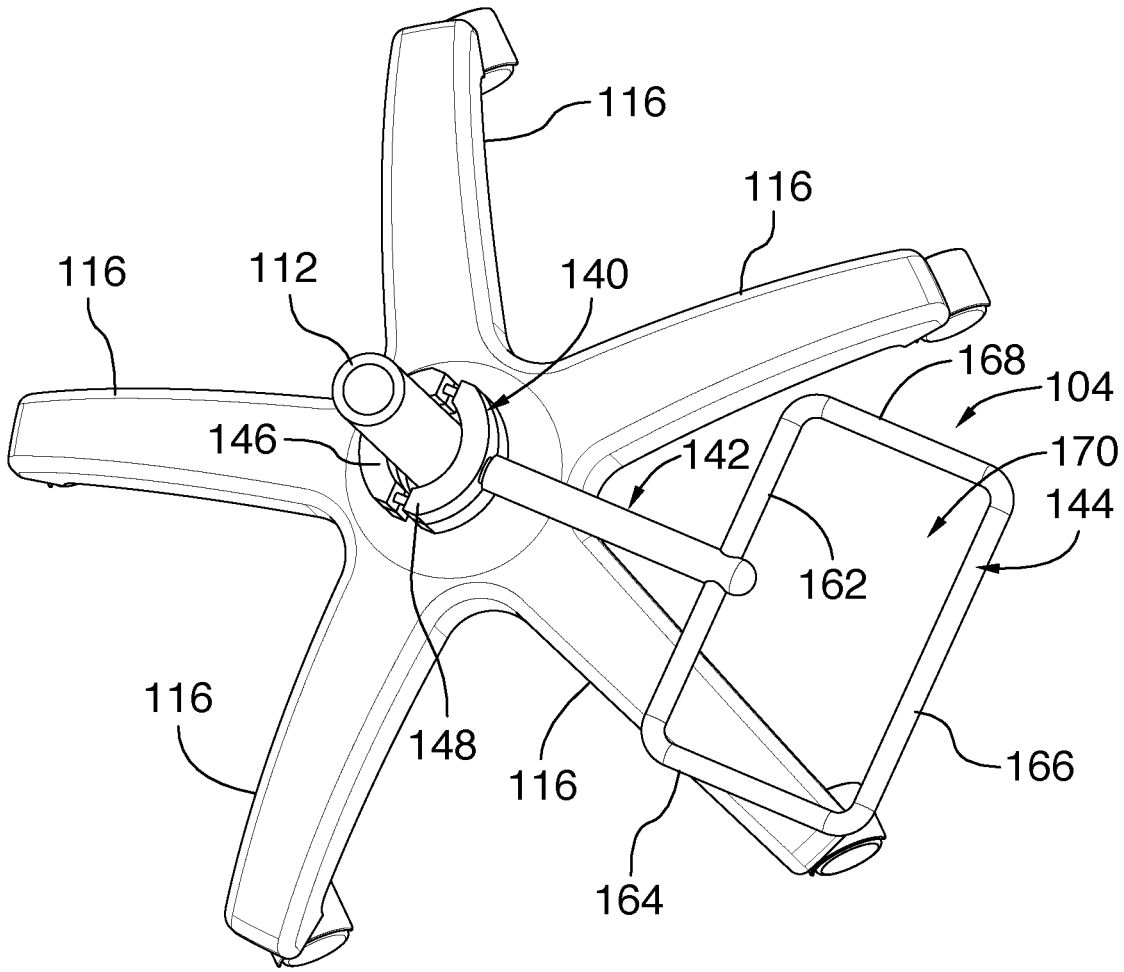
FIG. 4 illustrates a detail top-front perspective view of the foot and/or leg support device shown in FIG. 1.
Figure 5:
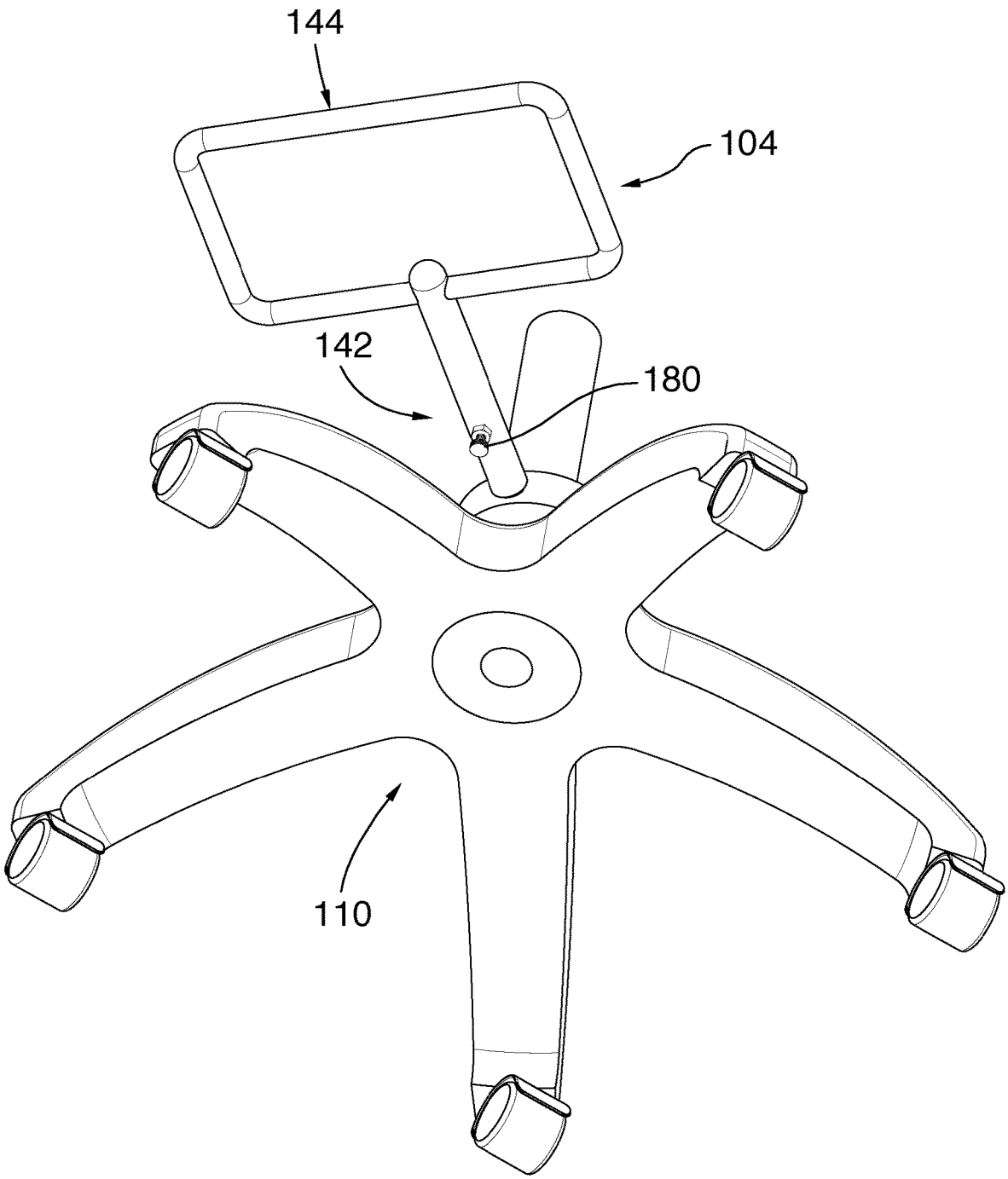
FIG. 5 illustrates a detail bottom-front perspective view of the foot and/or leg support device shown in FIG. 1.

Referring to FIG. 1, in an example embodiment, in the retracted configuration at least part of the support frame 144 extends past a vertical plane of the front seat edge 122 (FIG. 1) of the seat 120 of the chair 102. Therefore, in all positions including the retracted configuration and the extended configuration, a distal edge of the support frame 144 (e.g. frame member 166) can be horizontally positioned past the vertical plane of the front seat edge 122 (FIG. 1). As well, in the extended configuration, the distal edge of the support frame 144 extends past a vertical plane of the circumference defined by distal ends of the plurality of support legs 116 (FIG. 3).

For example, in the retracted configuration, a distal edge of the support frame 144 (e.g. frame member 166) can be horizontally positioned past the vertical plane of the front seat edge 122 (FIG. 1) by about 7.62 centimeters (3 inches). For example, in the extended configuration, a distal edge of the support frame 144 (e.g. frame member 166) can be horizontally positioned past the vertical plane of the front seat edge 122 (FIG. 1) by about 17.8 centimeters (7 inches). The support legs 116 can provide counter support against the moment of intertia when user weight is applied to the frame 144.

Reference is now made to FIGS. 5 to 8, which illustrate the extension mechanism in greater detail. As shown, the cantilever arm 142 includes a first telescopic member 172 and a second telescopic member 174. The first telescopic member 172 is nested within the second telescopic member 174. The first telescopic member 172 is slideable with respect to the second telescopic member 174 to adjust the support frame 144 to the extended configuration and to the retracted configuration.

Figure 6:
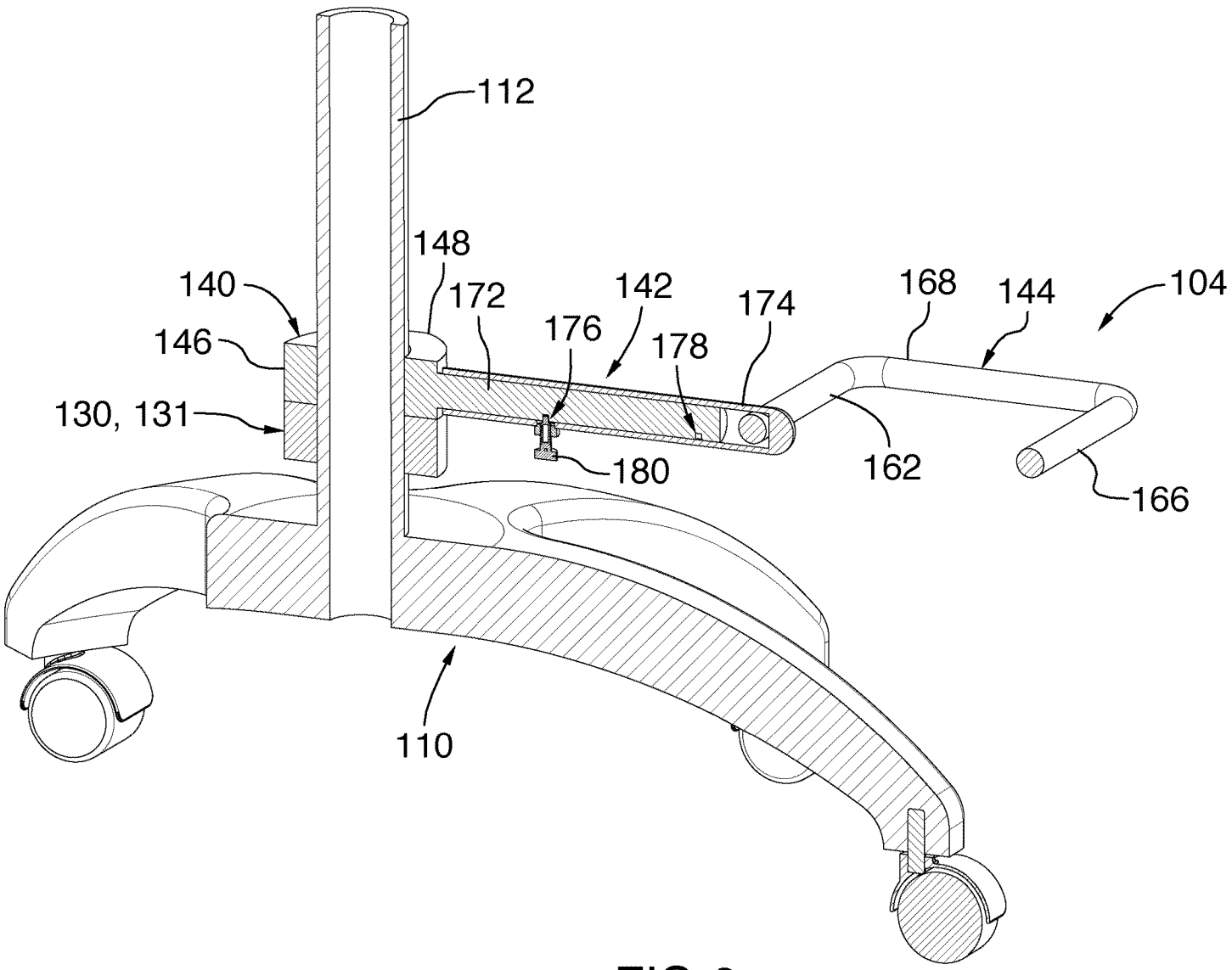
FIG. 6 illustrates a detail front-side sectional view of the foot and/or leg support device shown in FIG. 1 in a retracted configuration.
Figure 7:
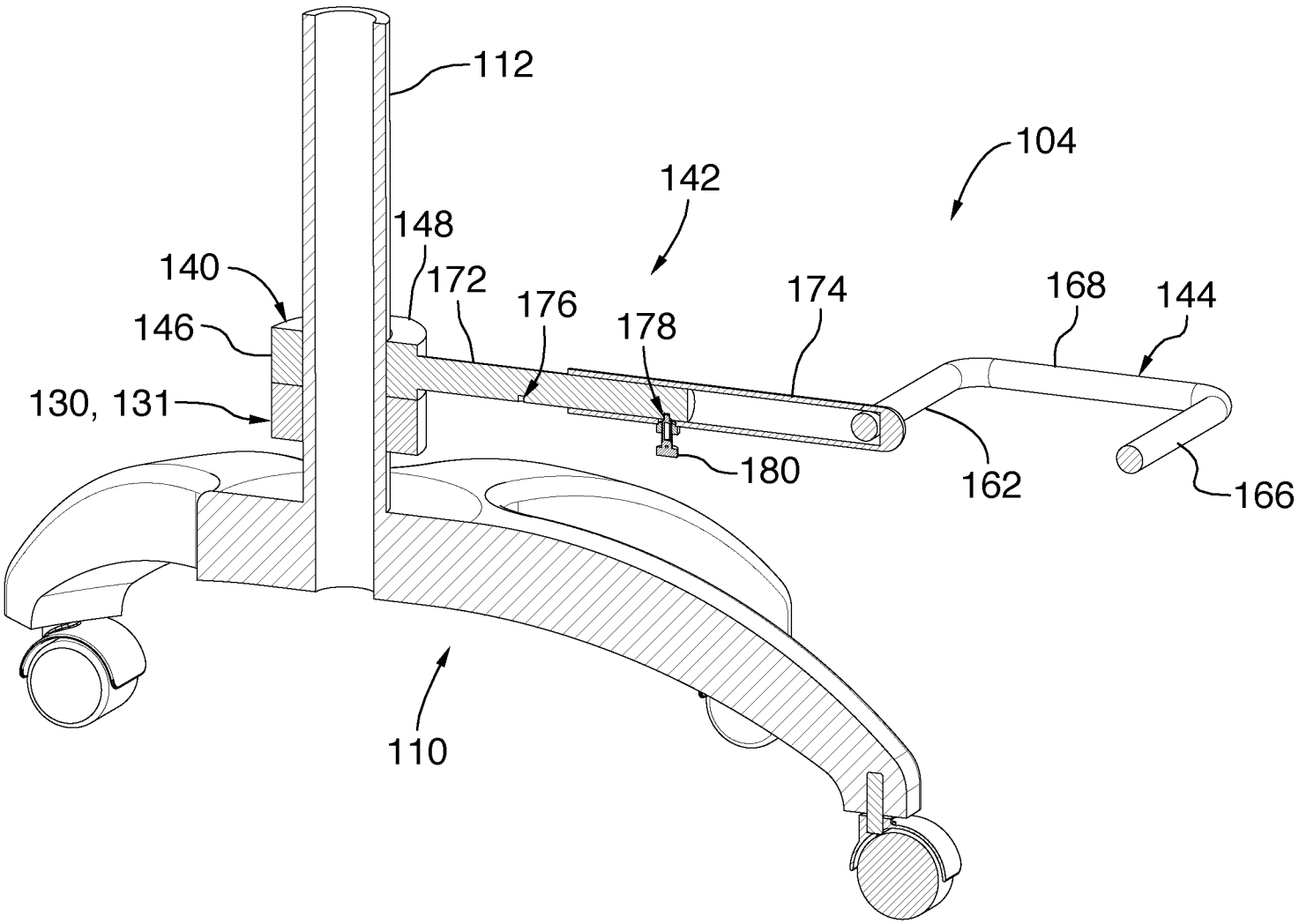
FIG. 7 illustrates the view of FIG. 6 in an extended configuration.

Referring to FIGS. 6 to 8, the second telescopic member 174 defines one or more adjustment holes 176, 178 (two shown in an example embodiment). An adjustment fastener, such as a spring-loaded plunger 180 can be inserted into the applicable adjustment holes 176, 178 when aligned. Insertion of the spring-loaded plunger 180 into the adjustment hole 176 results in the support frame 144 being maintained in the retracted configuration, while insertion of the spring-loaded plunger 180 into the other adjustment hole 178 results in the support frame 144 being maintained in the extended configuration. Pulling of the spring-loaded plunger 180 allows the spring-loaded plunger 180 to be removed from the applicable adjustment holes 176, 178 and the telescopic members 172, 174 can therefore be slid with respect to each other. As well, the second telescopic member 174, along with the support frame 144, can be entirely pulled out from the first telescopic member 172, in an example embodiment. As can be appreciated, less or more than two adjustment holes may be provided on either of the telescopic members 172, 174 to provide more or less horizontal adjustment positions.

In an example embodiment, not shown, a spring-loaded push button is used as the adjustment fastener, and can include a resilient mount or a bias member, such as a V-shaped metal spring or a coil spring. For example, the spring-loaded push button is mounted to the telescopic member 172, while the other telescopic member can have one or more adjustment holes to position particular lengths. The spring-loaded push button protrudes to engage one of the adjustment holes. The spring-loaded push button can be depressed so that the telescopic members 172, 174 can be slid with respect to each other. Additional adjustment fasteners may also be used, in an example embodiment. Other example types of adjustments fasteners include screws, bolts and pins.

Referring to FIG. 1, in an example embodiment, the spacer 130 is also mounted to the central post 112 to assist with vertical adjustment of the clamp 140. In an example embodiment, the spacer 130 is mounted directly on top of the base 110. In such an example, the spacer 130 is used to distribute downward force and weight from the support device 104 to the base 110 of the chair 102. Accordingly, clamping or pinching forces of the clamp 140 are not solely relied upon to maintain a position of the support device 104 onto the central post 112. Further, the face-to-face interaction between the spacer 130, the clamp 140, and the base 110 provides additional force transfer against the moment forces applied to the support device 104.

In some example embodiments, more than one of the spacers 130 can be used collectively onto the central post 112, to mount the support device 104 at higher specific heights, for example. Further, spacers 130 of different heights can be provided, and one or more can be selected to create the desired specific height.

In an example embodiment, there is provided a kit of parts containing components of the system(s) described herein, and suitable instructions for assembly thereof. In an example embodiment, the kit of parts can be provided which includes multiple spacers 130 of the same or different heights. In an example embodiment, the kit of parts can include two or more pairs of bolts 152, 156, such as one longer pair of bolts and one shorter pair of bolts. For example, the shorter pair of bolts can be used for installing onto smaller diameters of the central post 112, while the longer pair of bolts can be used for installing onto standard or larger diameters of the central post 112, Additional details of the spacer 130 will now be described, as best shown in FIG. 3. In an example embodiment, the spacer 130 itself includes a clamp 131 for attachment to the central post 112. In an example embodiment, the clamp 131 of the spacer 130 can include components which are substantially the same as the clamp 140, for example comprising two clamp parts shaped as of arcs, and two bolts, and two washers (not shown). In an example embodiment, the clamp 131 is installed at full tightness in order to provide vertical load support for the support device 104.

The height of the clamp 131 or body of the spacer 130 can have a specific height to define the specific desired distance between the support legs 116 and the clamp 140. In an example embodiment, the height of the clamp 131 for the spacer 130 is approximately the same as the height of the clamp 140 of the support device 104.

An example method of use includes selecting, from a plurality of possible spacers 130, one or more spacers 130 which collectively provide a desired height along the central post 112 for vertically positioning of the support device 104. The selected spacers 130 can then be clamped onto the central post 112.

Figure 16:
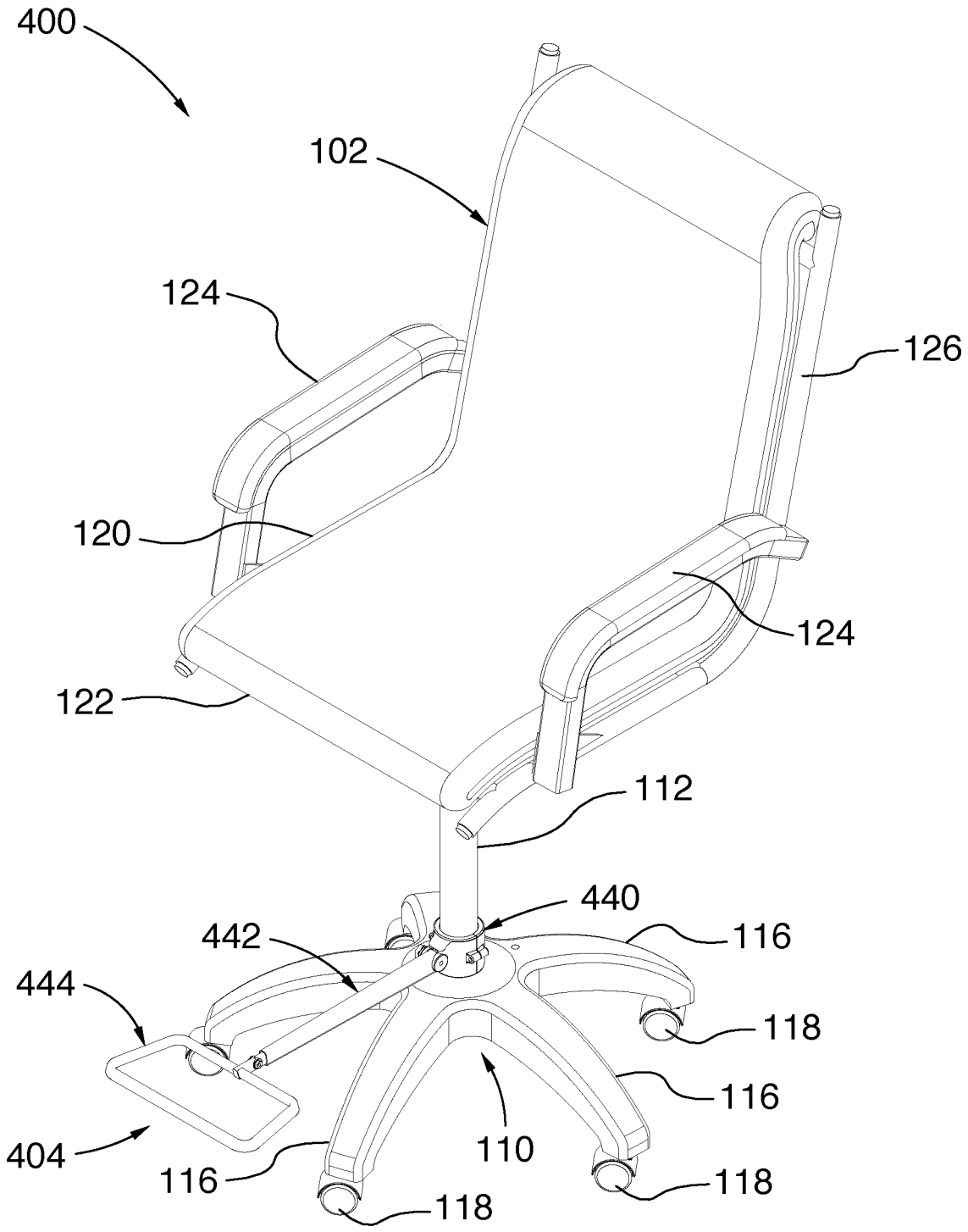
FIG. 16 illustrates a top-front perspective view of a foot and/or leg support system, including a foot and/or leg support device having vertical angle adjustability, in accordance with another example embodiment.

In another embodiment, for example as described herein with respect to at least FIG. 16, the arcs 146, 148 of the clamp 140 can each be on or about 180 degrees. This can be a specific configuration which is designed for specific radius sizes of the post 112 of the chair 102, or slightly smaller than such radius sizes which still permits full rotation when installed.

An example method of use of the clamp 140 includes installing the clamp 140 to, or removing the clamp 140 from, the post 112. The clamp 140 can be mounted onto the central post 112, just above the spacer 130. For example, the base 110 or the chair body 114 would not need to be disassembled from the chair 102 when mounting the clamp 140. The support frame 144 can then be extended or retracted with respect to the clamp 140 to a desired horizontal position.

Figure 13:
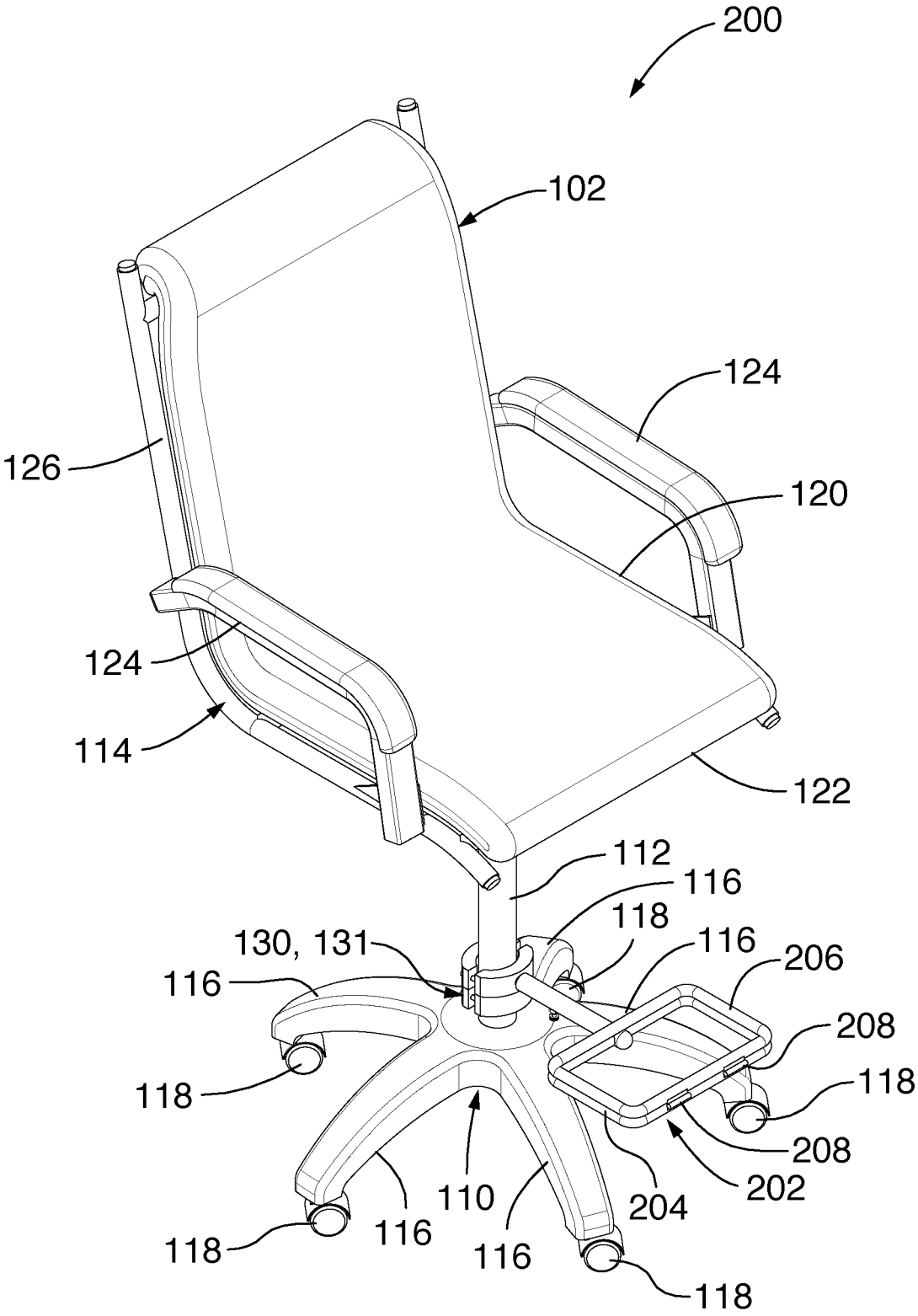
FIG. 13 illustrates top-front perspective view of a foot and/or leg support system, including a foot and/or leg support device having a flip-over support frame, the support frame shown in a flip-closed configuration, in accordance with another example embodiment.
Figure 14:
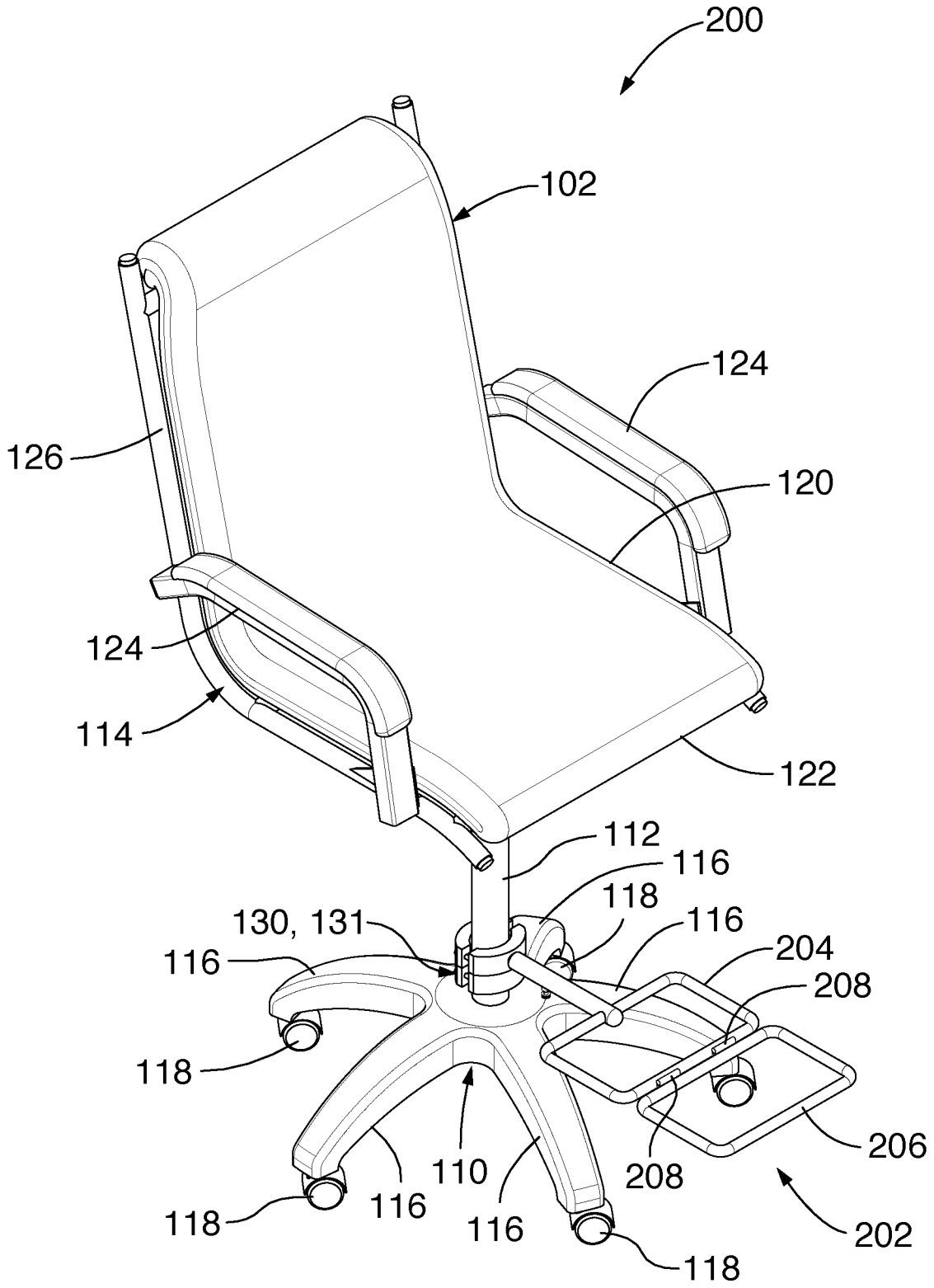
FIG. 14 illustrates the view of FIG. 13, the support frame shown in a flip-open configuration.

Reference is now made to FIGS. 13 and 14, which illustrate another foot and/or leg support system 200, in accordance with another example embodiment. The example embodiment shown differs from the system 100 of FIG. 1 in that another extension mechanism is illustrated, having a flip-over support frame 202 rather than merely the support frame 144. The remaining components can be the same or similar than that described with respect to the system 100, and similar reference numbers may be used for convenience of reference. FIG. 13 illustrates the flip-over support frame 202 in a flip-closed retracted configuration, and FIG. 14 illustrates the flip-over support frame 202 in a flip-open extended configuration. This provides another example extension mechanism, in accordance with an example embodiment.

As shown in FIGS. 13 and 14, in an example embodiment, the support frame 202 comprises a first support frame part 204 and a second support frame part 206 which can be of substantially same shape as the first support frame part 204. As shown, the first and second support frame parts 204, 206 each comprise an open perimeter of a shape, such as a rounded rectangular. In an example embodiment, the first frame part 204 is rigidly mounted to the distal end of the cantilever arm 142, and the second frame part 206 is pivotally connected to the first frame part 204.

As shown in FIGS. 13 and 14, in an example embodiment, at least one pivot or hinge (two shown) 208 connects the first support frame part 204 and the second support frame part 206 at the distal end, to adjust the support frame to the extended configuration. The range of rotation of the hinges 208 can be zero degrees in the flip-closed configuration and can be 180 degrees in the flip-closed configuration. The hinges 208 can themselves have 180 degree limitations in an example embodiment. In other example embodiments, a thickness of the first and second support frame parts 204, 206 or other stops can be used to limit the pivoting to approximately 180 degrees. In other example embodiments, the second frame part 206 is limited to rotate to a slightly raised position, such as 160 degrees or 170 degrees. In other example embodiments, the second frame part 206 is configured to stop rotation at a slightly downward sloped position, such as 190 degrees or 200 degrees from the starting position.

In operation, the flip-over support frame 202 can be in the flip-closed retracted configuration for shorter individuals, and can be in the flip-open extended configuration for taller individuals. Further horizontal adjustment can be combined with the telescopic features of the cantilever arm 142 described above, in accordance with an example embodiment.

As would be apparent, in some example embodiments, the support device 104 can be used to securely mount the support device 104 to varying sizes of central posts 112 of the chair 102, can have a pivoting cantilever arm 142, can be extended to permit horizontal adjustability, and can include one or more spacers to provide varying adjustable vertical positions on the central post 112 for customized support. In an example embodiment, the support device can be used to support correct posture and/or for customized comfort to a user in a seated position.

The support device 104 allows the user to prop the feet up and to rest them on a support so as to encourage the body to adjust to an upright seated position. This allows for the legs to be at approximately 90 degree angle to the hips and the knees to be at approximately 90 to 110 degree angle to the legs with feet in front. With the standard desk or table height, users who are of shorter stature and who require the seat of a chair to be elevated can use the support device 104 to maintain the correct posture.

Figure 15:
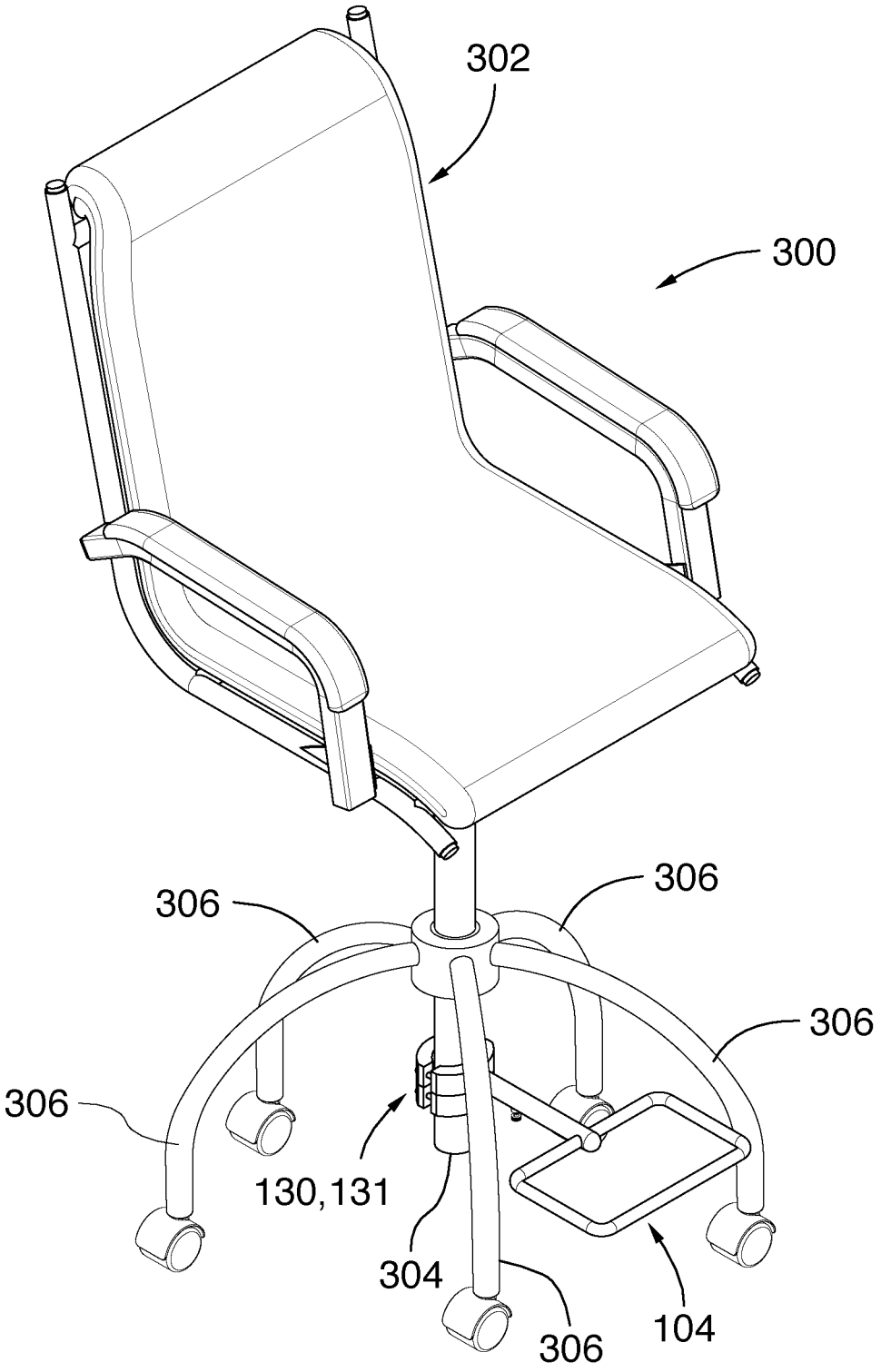
FIG. 15 illustrates a perspective view of another foot and/or leg support system, including the foot and/or leg support device attached to another type of chair, in accordance with another example embodiment.

FIG. 15 illustrates a perspective view of another foot and/or leg support system 300, illustrating the foot and/or leg support device 104 attached to another type of chair 302, in accordance with another example embodiment. The chair 302 is a type that has a central post 304 and a plurality of support legs 306 which are attached at a relatively higher position to the central post 304, closer to the seat of the chair 302. Therefore, the central post 304 of the chair 302 extends vertically below the attachment point or base of the support legs 306.

As shown in FIG. 15, in an example embodiment, the clamp 140 is mounted on the central post 304 under the connection point at the base and protrudes between two of the support legs 306.

The spacer 130 and the clamp 131 are positioned just below the support device 104, which provides support against vertical loads that are effected by the user onto the support device 104.

Reference is now made to FIG. 16, which illustrates another example foot and/or leg support system 400, in accordance with another example embodiment. The system 400 includes a foot and/or leg support device 404 for detachable connection to the chair 102. Generally, in example embodiments, the support device 404 can be configured with vertical angle adjustability and/or has clamp dimensions that generally match the dimensions of the post 112 of the chair 102.

Reference is now made to FIGS. 16 to 21, which illustrate the support device 404 in greater detail. The support device 404 includes a connector comprising a clamp 440 for clamping onto the central post 112, a cantilever arm 442 having a proximal end connected to the clamp 440, and a support frame 444 mounted to a distal end of the arm 442. The support frame 444 is for supporting the legs and/or feet of the user when sitting on the chair 102, for example. In an example embodiment, only exactly one cantilever arm 442 is used.

The clamp 440 can be angularly adjusted vertically after installation, in an example embodiment. A first pivot such as a hinge 490 connects the cantilever arm 442 with the 440 clamp. The hinge 490 can be a rod and aperture type of hinge. In an example embodiment, the hinge 490 provides pivoting in only vertical angles, for example, thereby permitting the cantilever arm 442 to correspondingly pivot only vertically. A lock 492 can be used to variably tighten and loosen operation of the hinge 490. The lock 492 can comprise a manually adjustable knob, as shown. In another example embodiment, the lock 492 can comprise a head shaped to receive a corresponding tool head shape, for example. In another example embodiment, the lock 492 has binary mode of operation, being solely locked and unlocked.

A second pivot such as second hinge 494 connects the cantilever arm 442 to the support frame 444. The second hinge 494 can be a rod and aperture type of hinge. The hinge 494 provides pivoting in only vertical angles, in an example embodiment, thereby permitting the support frame 444 to correspondingly pivot vertically. A lock 496 can be used to variably tighten and loosen operation of the second hinge 494. In some example embodiments, the lock 496 can comprise a knob, a handle, or have a head shaped to receive a corresponding tool head shape. In another example embodiment, the lock 496 has binary mode of operation, being locked and unlocked.

Figure 24:
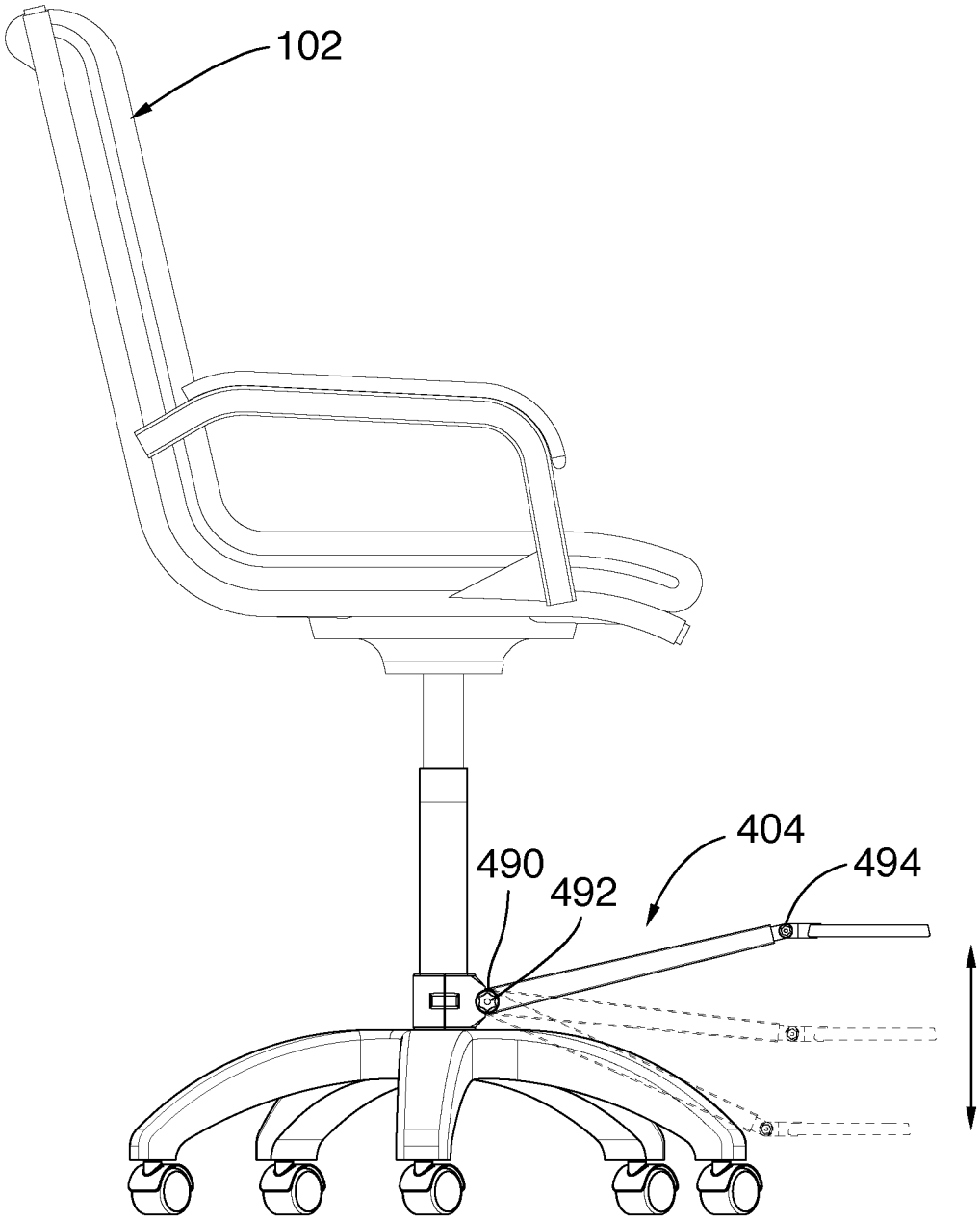
FIG. 24 illustrates a side view of the system shown in FIG. 16 illustrating vertical angle adjustment configurations.

Reference is now made to FIG. 24, which illustrates the vertical angle adjustment feature of the support device 404. As shown in FIG. 24, the first hinge 490 can be adjusted so that the cantilever arm 442 is set at the desired vertical angle. This, for example, can allow the device 404 to work with variable chair geometry, and also allow the user to adjust to their required level of comfort. As well, the second hinge 494 can be adjusted so that the support frame 444 is at the desired angle. For example, the support frame 444 can be adjusted so that it is always generally horizontal and parallel to the ground, as shown, no matter what is the vertical angle of the cantilever arm 442.

Figure 23:
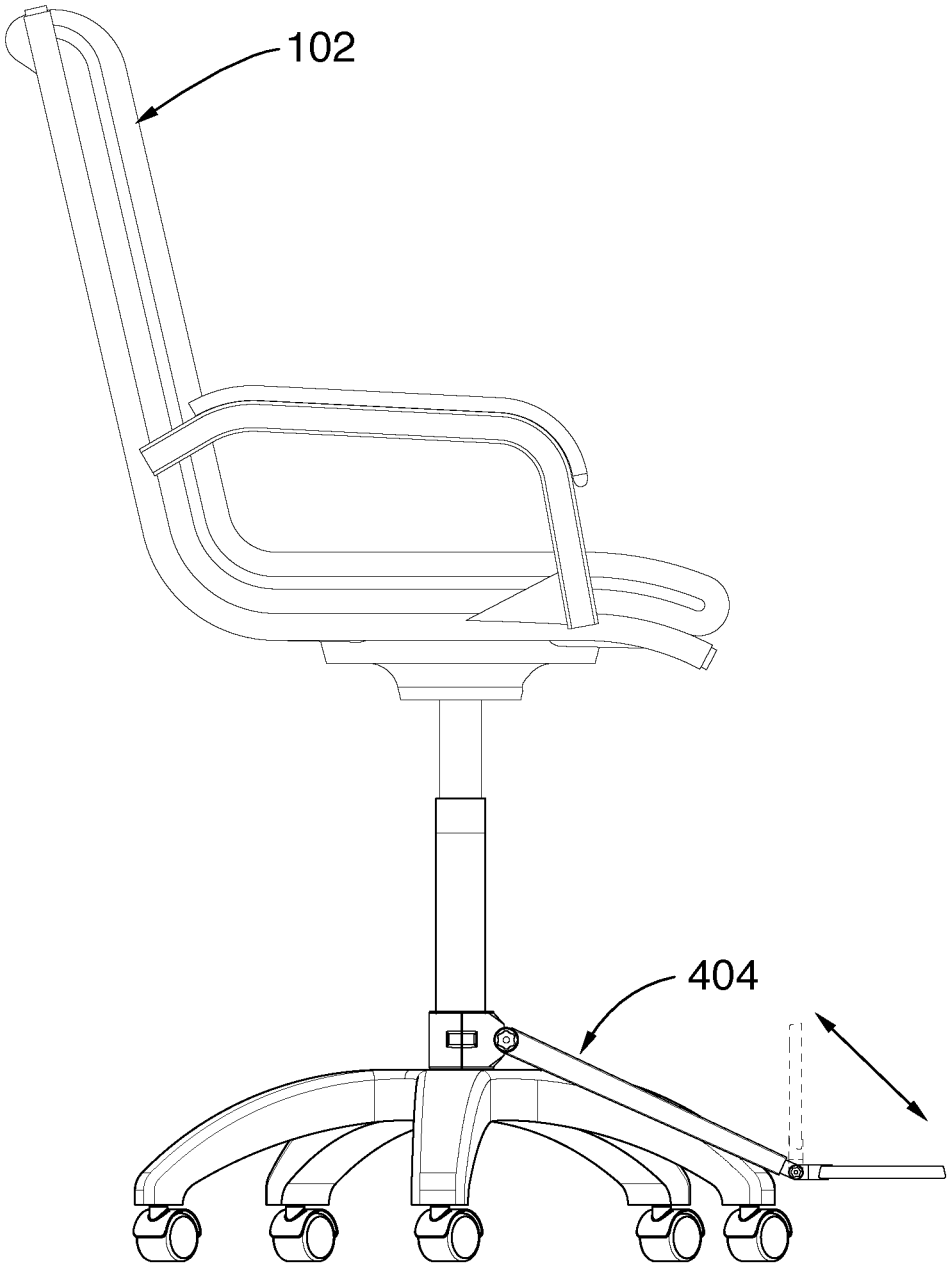
FIG. 23 illustrates a side view of the system shown in FIG. 16 illustrating a support frame storage and support frame use configuration.

Reference is now made to FIG. 23, which illustrates a storage or retraction feature of the support frame 444 of the support device 404. As shown in FIG. 23, the second hinge 494 can be pivoted so that the support frame 444 can be stored and retracted. This pivoting feature allows the support frame 444 to be folded up when not in use, for example. In some example embodiments, the support frame 444 can be folded back nearly or all the way back to the cantilever arm 442. Locks or stops can be used to define the specific stop angle. When desired to be used, the support frame 444 can be folded out to the original extended configuration by pivoting about the second hinge 494.

Figure 17:
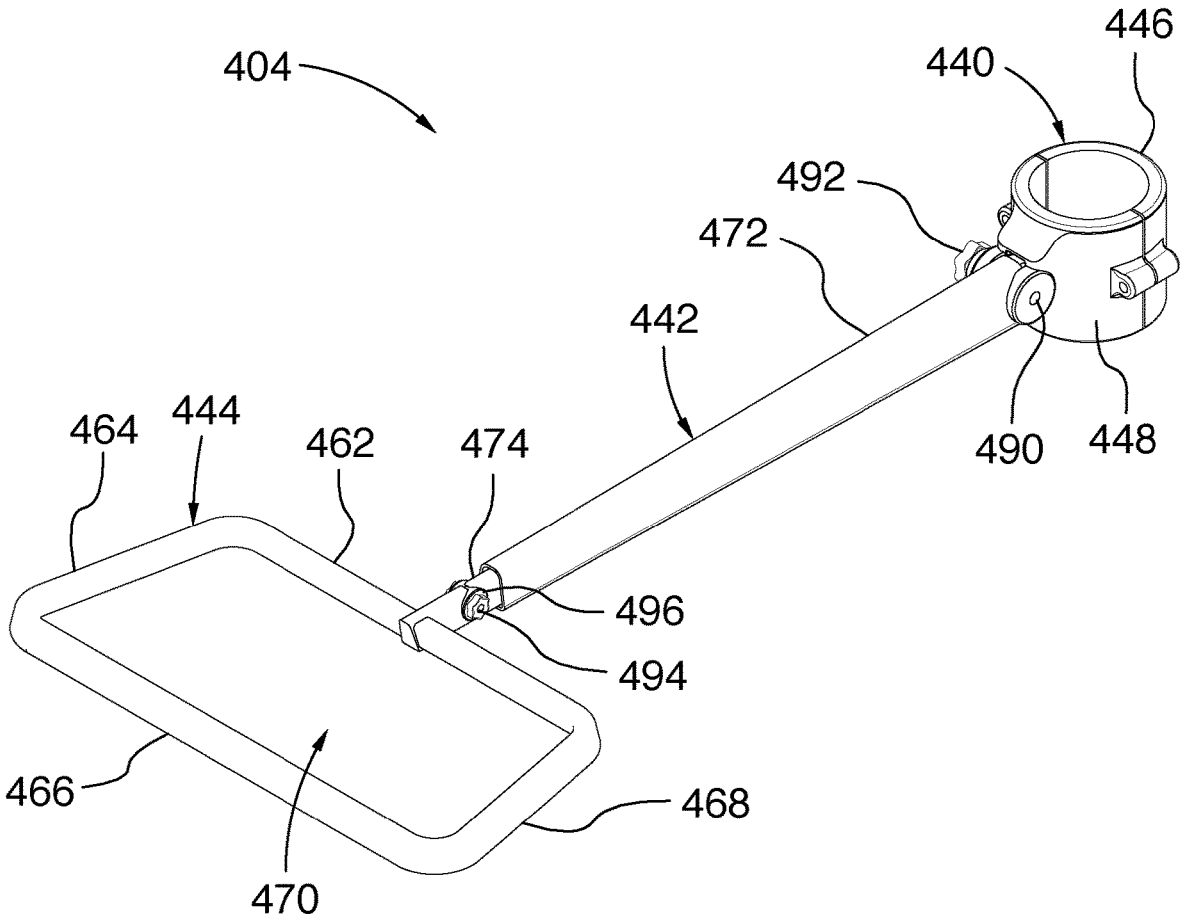
FIG. 17 illustrates a detail top-front perspective view of the foot and/or leg support device shown in FIG. 16.
Figure 18:
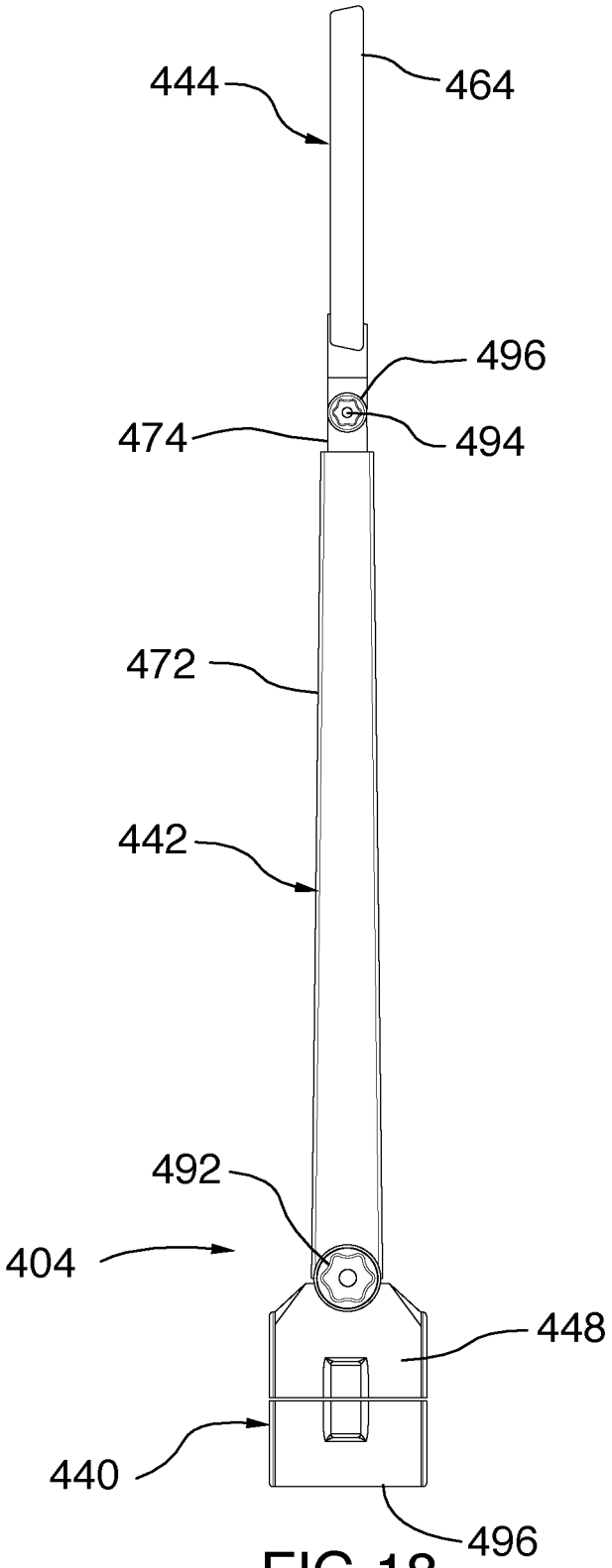
FIG. 18 illustrates a detail left side view of the foot and/or leg support device shown in FIG. 16.
Figure 19:
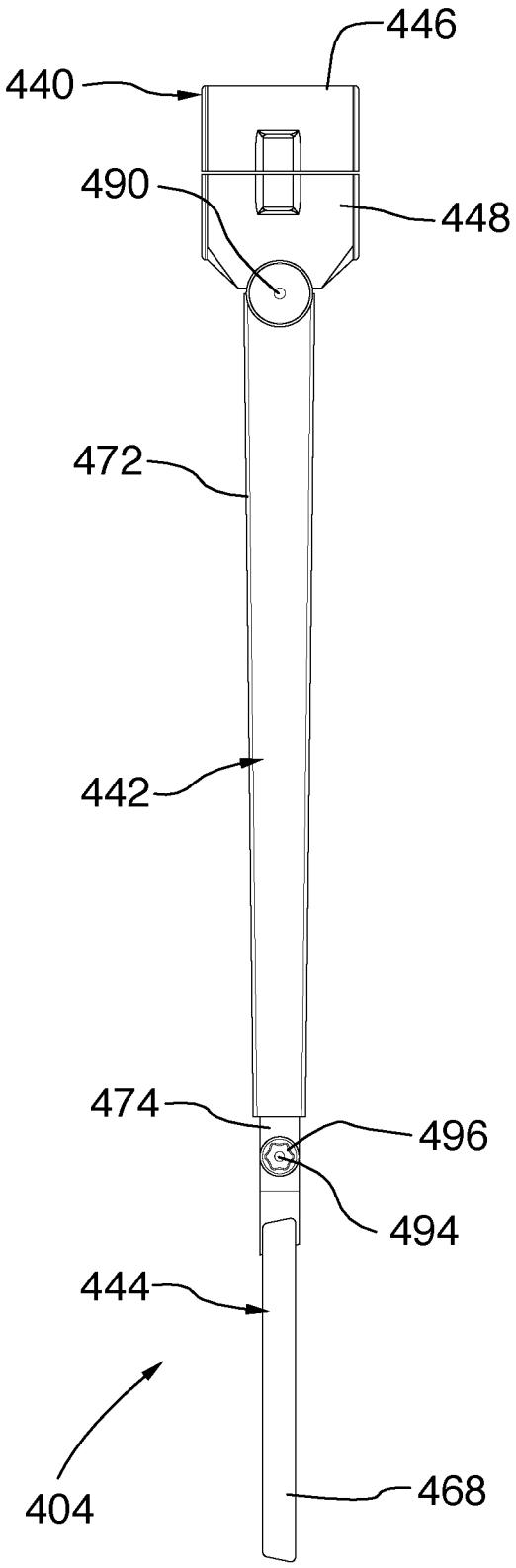
FIG. 19 illustrates a detail right side view of the foot and/or leg support device shown in FIG. 16.
Figure 20:
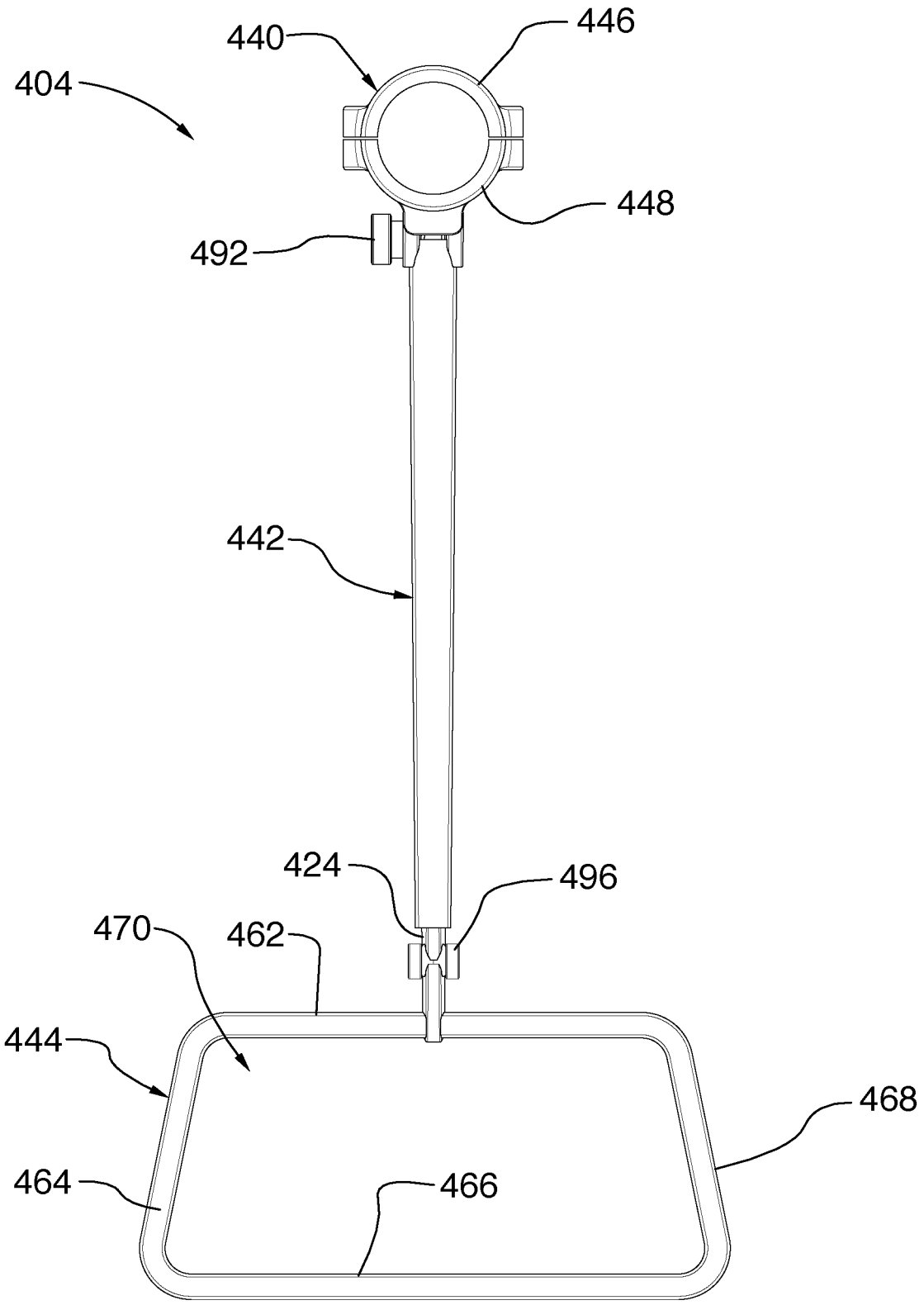
FIG. 20 illustrates a detail top view of the foot and/or leg support device shown in FIG. 16.

As shown in FIG. 17, the clamp 440 includes a first clamp part 446 and a second clamp part 448. The proximal end of the arm 442 is mounted to the second clamp part 448 by way of the hinge 490. Each clamp part 446, 448 has an inner arc angle measure of on or about 180 degrees (e.g. semi-circles) which is shaped as an arc in order to snugly fit around the central post 112 of the chair 102. The central post 112 has a radius which is the same or about the same as the inner radius (radius of curvature) of each clamp part 446, 448. When assembled, the clamp parts 446, 448 collectively define an interior cylindrical surface for surrounding the central post 112.

Still referring to FIG. 17, the clamp 440 further includes a first fastener such as a first bolt (not shown) for connecting the first clamp part 446 and the second clamp part 448 at one side of the central post 112. The clamp 440 includes a second fastener such as a second bolt (not shown) for connecting the first clamp part 446 and the second clamp part 448 at an opposite side of the central post 112.

For example, the clamp 440, and consequently the support frame 444, can be rotated horizontally about the central post 112 when installed. For example, when installed onto the central post 112, the support frame 444 can be rotated away to a rear position when not in use, or into a frontal position when desired to be used. In an example embodiment, an interior facing of the clamp 440 can include a friction reducing coating or material to facilitate the 360 rotational horizontal movement when installed.

In example embodiments, as shown in FIG. 16, the clamp 440 can be vertically supported by the base 110 of the chair 102. In an example embodiment, the clamp 440 can be vertically supported by one or more of the spacers 130 (e.g., FIG. 1), as described herein.

The support frame 444 will now be described in greater detail, as shown in FIG. 17. The support frame 444 provides a structure for resting of the legs and/or feet of the user when sitting on the chair 102, for example. As shown, the support frame 444 comprises a perimeter of a shape, such as a rounded trapezoid. The perimeter is therefore open or unfilled. The perimeter can include frame members 462, 464, 466, 468 which are flat strips, tubes, rods, or other cross-sectional shapes. One frame member 462 is mounted to the cantilever arm 442 by way of hinge 494. In an example embodiment, the frame member 466 can be on or about 27.94 cm (11 inches) in length, the frame member 462 can be on or about 22.86 cm (9 inches) in length, and frame members 464, 468 can be on or about 20.3 centimeters (8 inches).

The perimeter of the support frame 444 defines an aperture 470 which is the entire space within the perimeter. For example, this requires less material to be used. In another example embodiment, the perimeter of the support frame 444 is filled in or solid, without the aperture 470.

Figure 25A:
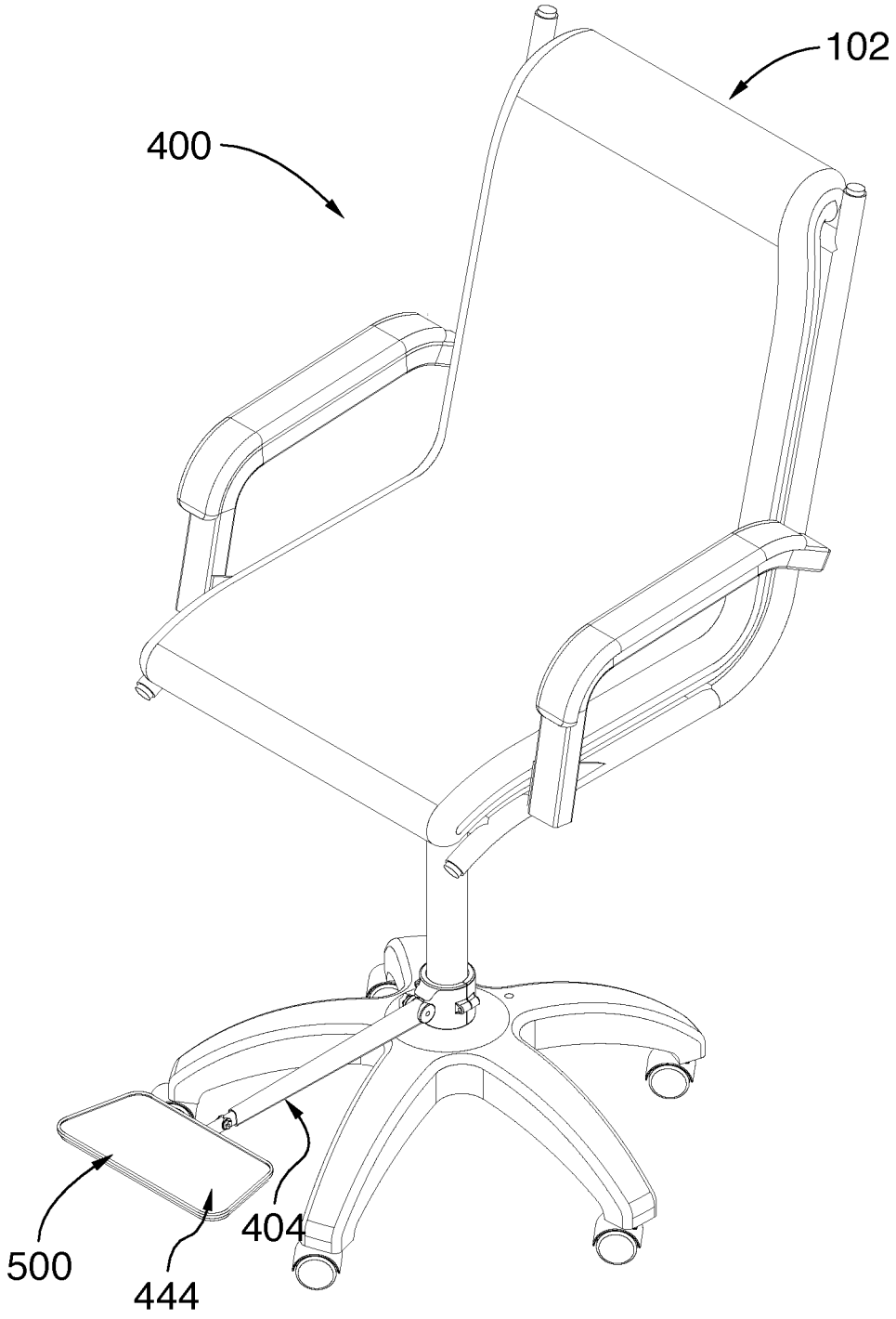
FIG. 25A illustrates a perspective view of the system shown in FIG. 16 with an accessory tray system, in accordance with an example embodiment.
Figure 25B:
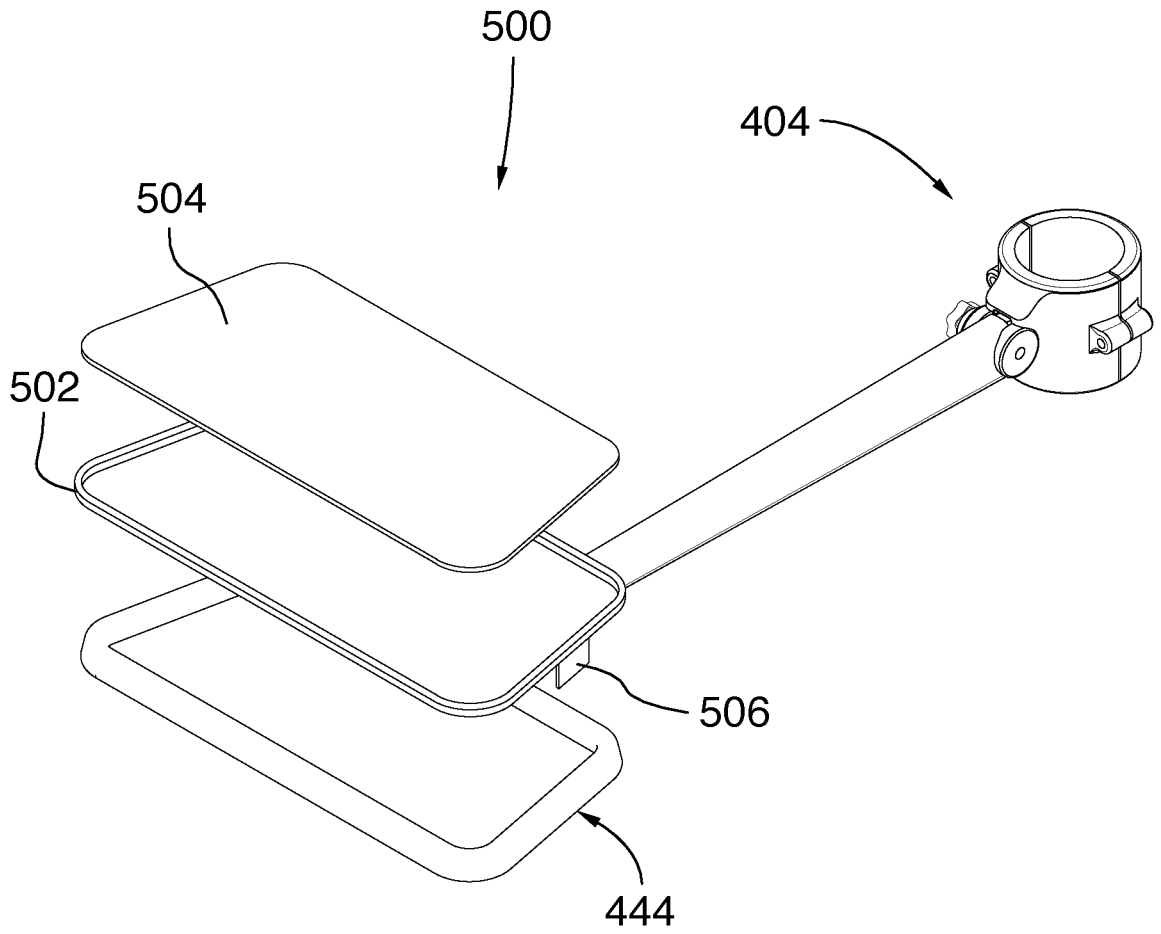
FIG. 25B illustrates a detail perspective exploded view of the accessory tray system shown in FIG. 25A.
Figure 25C:
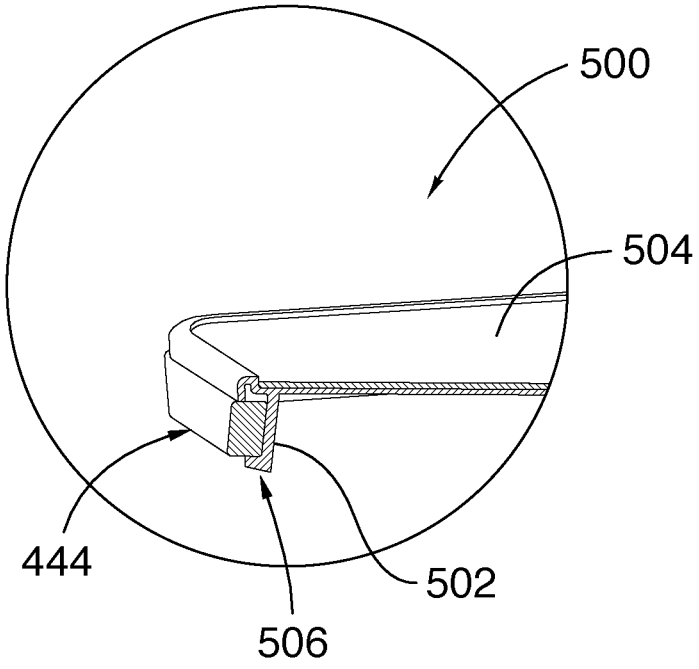
FIG. 25C illustrates a detail sectional of the accessory tray system shown in FIG. 25A.

FIGS. 25A, 25B and 25C illustrate an example accessory tray system 500 for the foot and/or leg support system 400, in accordance with an example embodiment. In an example embodiment, the accessory tray system 500 can be used to fill in the aperture 470 of the support frame 444. The accessory tray system 500 can be assembled as one piece at the manufacturer, in an example embodiment, for delivery to the customer. As shown, the accessory tray system 500 includes a base tray 502 connected to a swatch plate 504. The base tray 502 may include an attachment mechanism or a fastener, e.g., may be integrally shaped to comprise at least one snap-fit fastener 506 (two in this example) which corresponds to the perimeter shape of the support frame 444. The accessory tray system 500 fills the unfilled perimeter of the support frame 444. The base tray 502 can be installed without tools, for example, and can snap onto the support frame 444. The base tray 502 can be formed of resilient material, such as plastic, in order for the snap-fit fastener 506 to mount onto the support frame 444. The swatch plate 504 can allow for different colors, designs, materials and/or finishes to be integrated onto the support frame 444 of the support device 404. The swatch plate 504 can comprise plastic material in an example embodiment. In an example embodiment, the swatch plate 504 can include surface ridges and/or surface bumps to facilitate foot circulation. The swatch plate 504 can comprise rubber material in an example embodiment, for example to increase friction and reduce slippage. In an example embodiment, the swatch plate 504 is not required and the base tray 502 can be standalone, and can have various colors and/or designs.

Figure 26A:
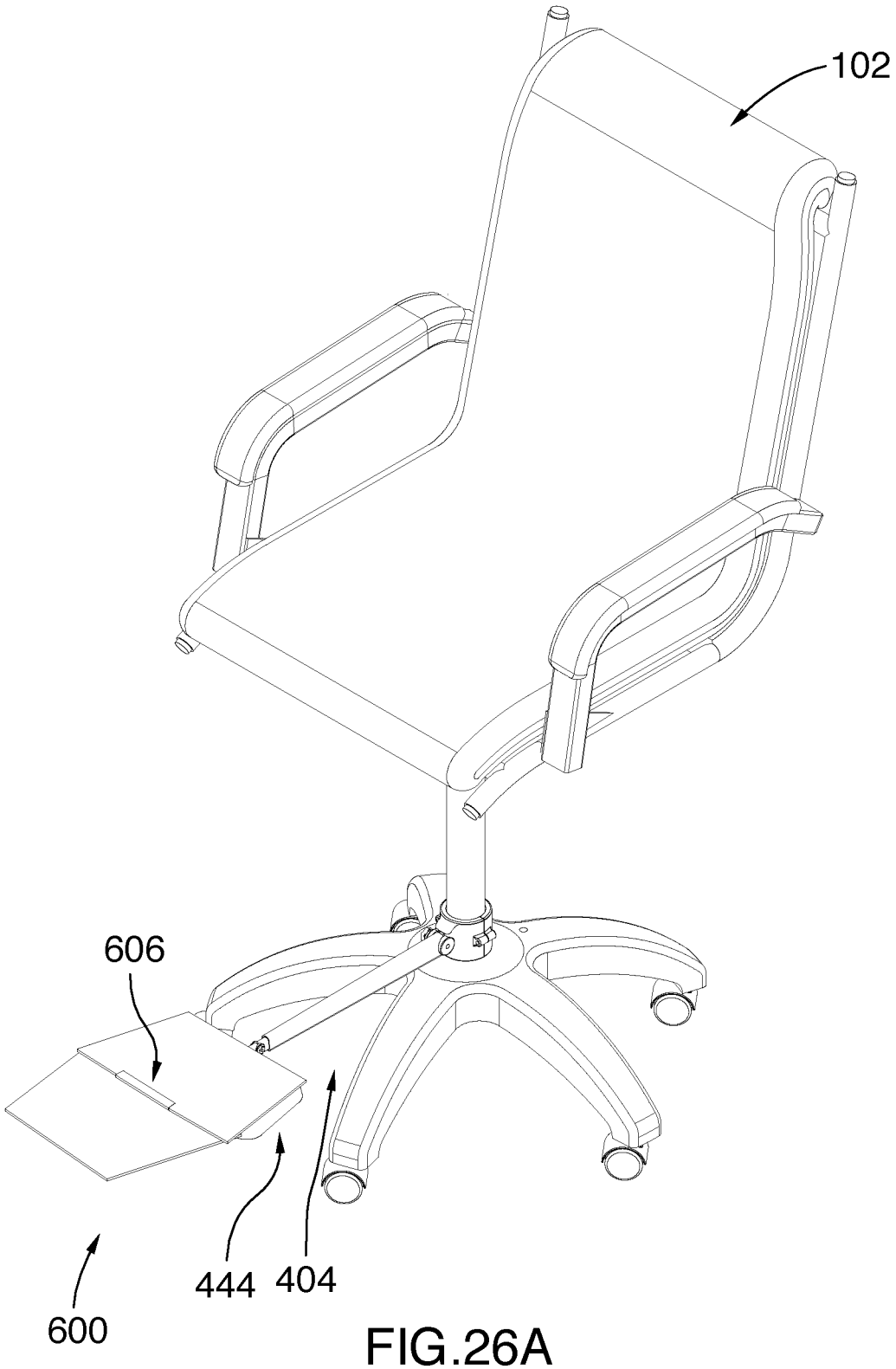
FIG. 26A illustrates a perspective view of the system shown in FIG. 24A with a foldable accessory tray system, in accordance with an example embodiment.
Figure 26B:
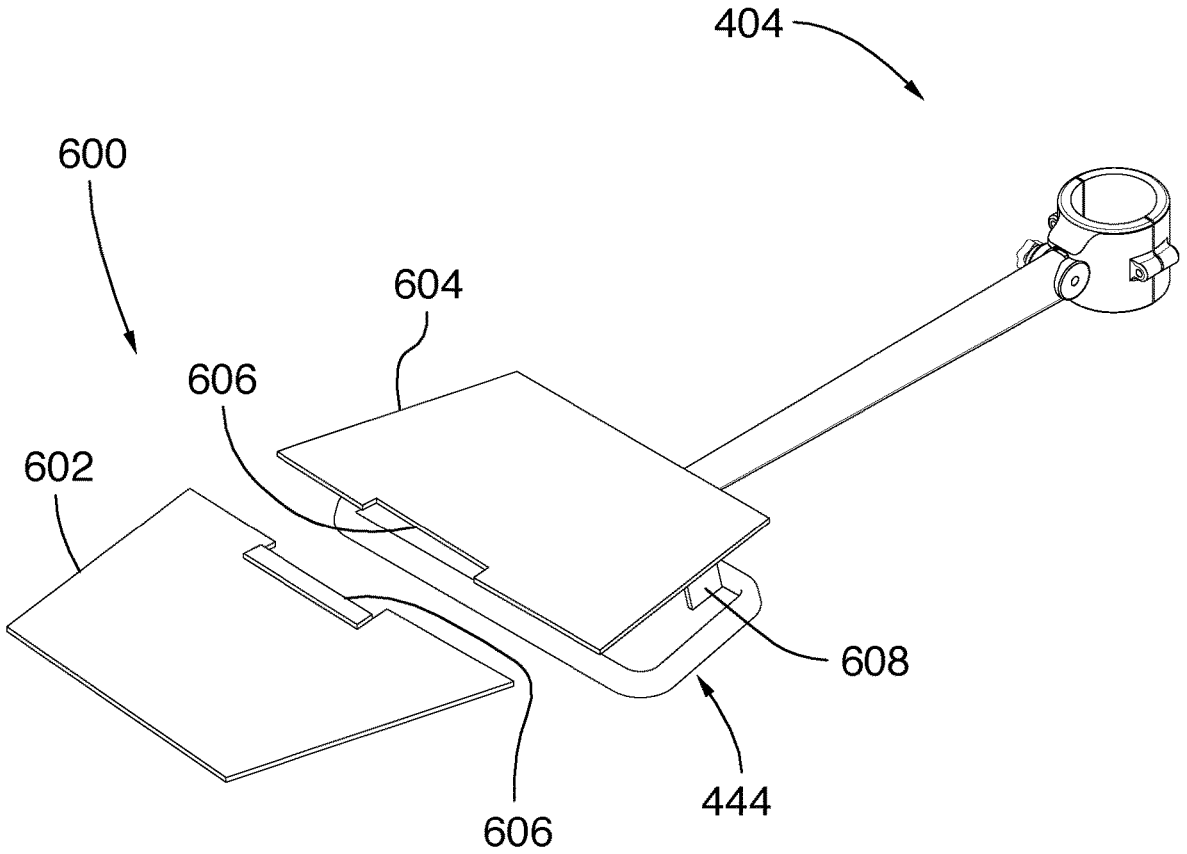
FIG. 26B a detail perspective exploded view of the accessory tray system shown in FIG. 26A.

FIGS. 26A and 26B illustrate another example accessory tray system 600 for the foot and/or leg support system 400, and which includes an extension mechanism, in accordance with another example embodiment. The accessory tray system 600 includes first tray part 602 and second tray part 604. The accessory tray system 600 can be assembled as one piece at the manufacturer, in an example embodiment. As shown, the second tray part 604 can be oversized in terms of perimeter dimension when compared to the perimeter shape of the support frame 444. The first tray part 602 can be of similar dimension to the second tray part 604, or in other example embodiments can have different perimeter dimension size (not shown). The second tray part 604 may be integrally shaped to comprise at least one snap-fit fastener 608 (two in this example) which connects to the support frame 444. The accessory tray system 600 fills the unfilled perimeter or aperture 470 of the support frame 444. The second tray part 604 can be installed onto the support frame 444 without tools, and can snap onto the support frame 444. The accessory tray system 600 can be formed of resilient material, such as plastic, in order for the snap-fit fastener 608 to mount onto the support frame 444.

A pivot such as a hinge 606 connects the first tray part 602 to the second tray part 604, which allows pivoting there between. For example, the first tray part 602 can be flipped open (stopping on or about 180 degrees) when it is desired to extend the accessory tray system 600 to an extended position. When it is desired to be in the retracted position, the first tray part 602 can be flipped closed, so that a face of the first tray part 602 engages the second tray part 604. The polygonal dimensions of the first tray part 602 and the second tray part 604 can be approximately the same, in an example embodiment.

Figure 21:
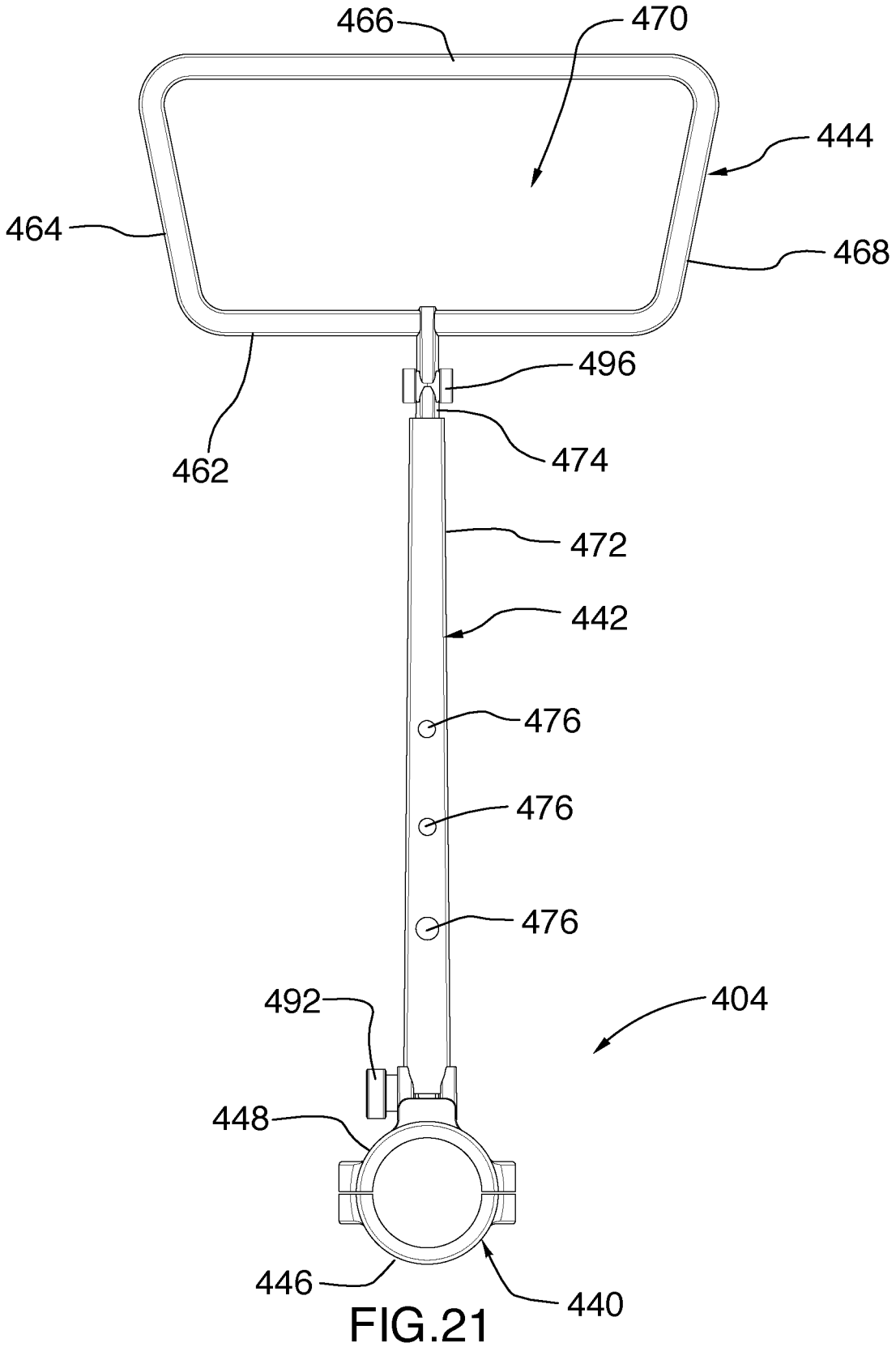
FIG. 21 illustrates a detail bottom view of the foot and/or leg support device shown in FIG. 16.
Figure 22:
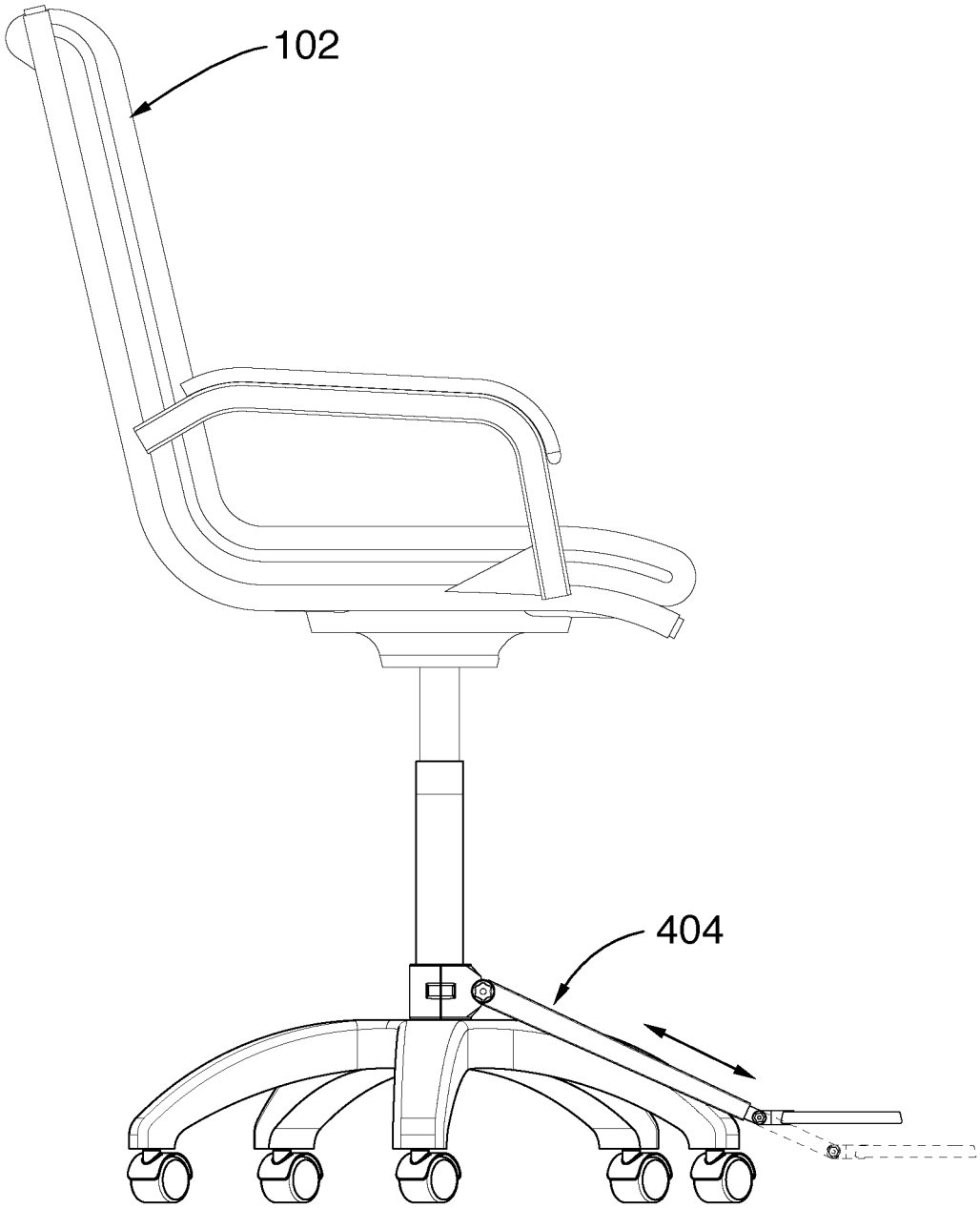
FIG. 22 illustrates a side view of the system shown in FIG. 16 illustrating an extension configuration.

Referring to FIGS. 21 and 22, in an example embodiment, an extension mechanism can be used to further extend the support frame 444 from the clamp 440 to an extended configuration, or can be retracted to a retracted configuration.

Referring to FIG. 22, in an example embodiment, in the retracted configuration at least part of the support frame 444 extends past a vertical plane of the front seat edge 122 of the seat 120 of the chair 102. In an example embodiment, the cantilever arm 442 can have a length that is on or about 25.4 centimeters (10 inches) in the retracted configuration and 38.1 cm (15 inches) in extended configuration. Therefore, in some example embodiments, in all positions including the retracted configuration and the extended configuration, a distal edge of the support frame 444 (e.g. frame member 466) can be horizontally positioned past the vertical plane of the front seat edge 122. As well, in the extended configuration, the distal edge of the support frame 444 extends past a vertical plane of the circumference defined by distal ends of the plurality of support legs 116. The support legs 116 can provide counter support against the moment of intertia when user weight is applied to the frame 444. In other example embodiments, in the retracted configuration, cantilever arm 442 is of a length such that the distal edge of the support frame 444 is positioned behind or before the front seat edge 122 of the task chair 102.

Still referring to FIGS. 21 and 22, as shown, the cantilever arm 442 includes a first telescopic member 472 and a second telescopic member 474. The second telescopic member 474 is nested within the first telescopic member 472. The second telescopic member 474 is slideable with respect to the first telescopic member 472 to adjust the support frame 444 to the extended configuration and to the retracted configuration. In another example embodiment, the first telescopic member 472 is nested within the telescopic member 474. In such an embodiment, the first telescopic member 472 can have a solid core. This solid core can allow further strength against load moments of inertia from the user's weight effected onto the support frame 444, for example.

Referring to FIG. 21, the first telescopic member and/or the second telescopic member 474 define one or more adjustment holes 476 (three shown in an example embodiment). An adjustment fastener, such as a spring-loaded plunger (not shown) can be inserted into the applicable adjustment holes 476 when aligned. Insertion of the spring-loaded plunger into the applicable adjustment hole 476 results in the support frame 444 being maintained in the retracted configuration or the extended configuration, as applicable. As can be appreciated, less or more than three adjustment holes may be provided on either of the telescopic members 472, 474 to provide more or less horizontal adjustment positions.

In another example embodiment, not shown, a spring-loaded push button is used as the adjustment fastener. Additional adjustment fasteners may also be used, in an example embodiment. Other example types of adjustments fasteners include screws, bolts and pins.

Figure 27A:
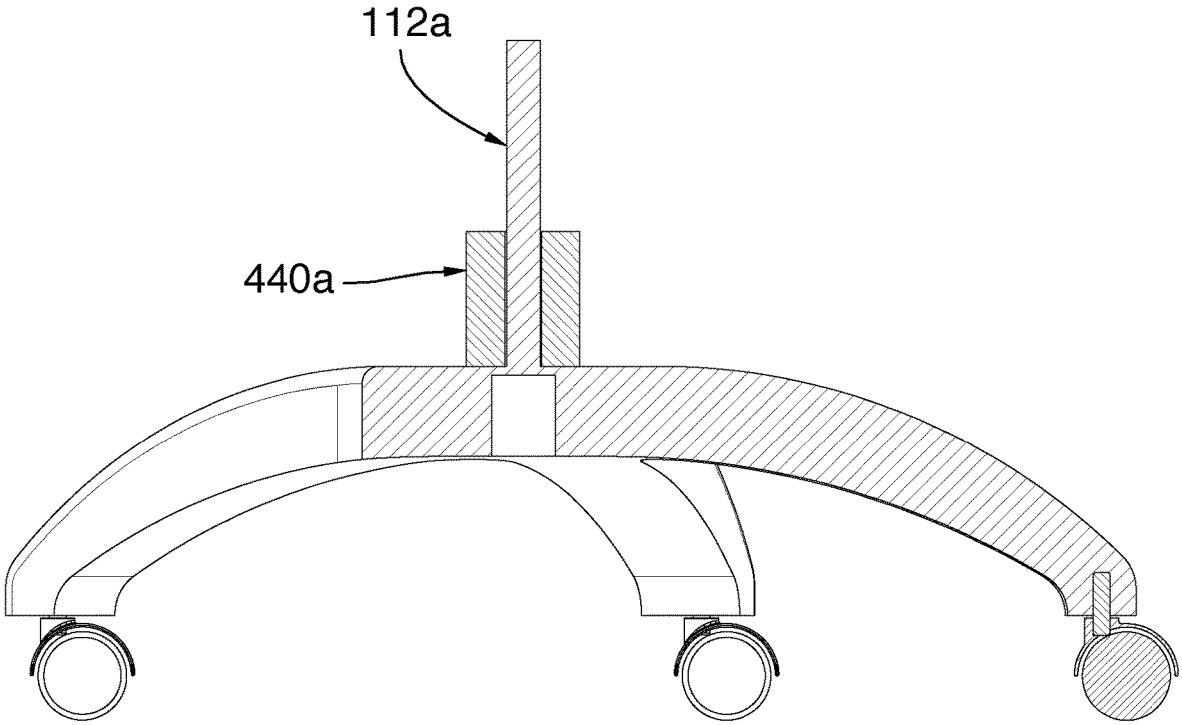
FIG. 27A illustrates a section view of an example embodiment of the system in FIG. 16 for attachment to a chair post with thin post and thick collar.
Figure 27B:
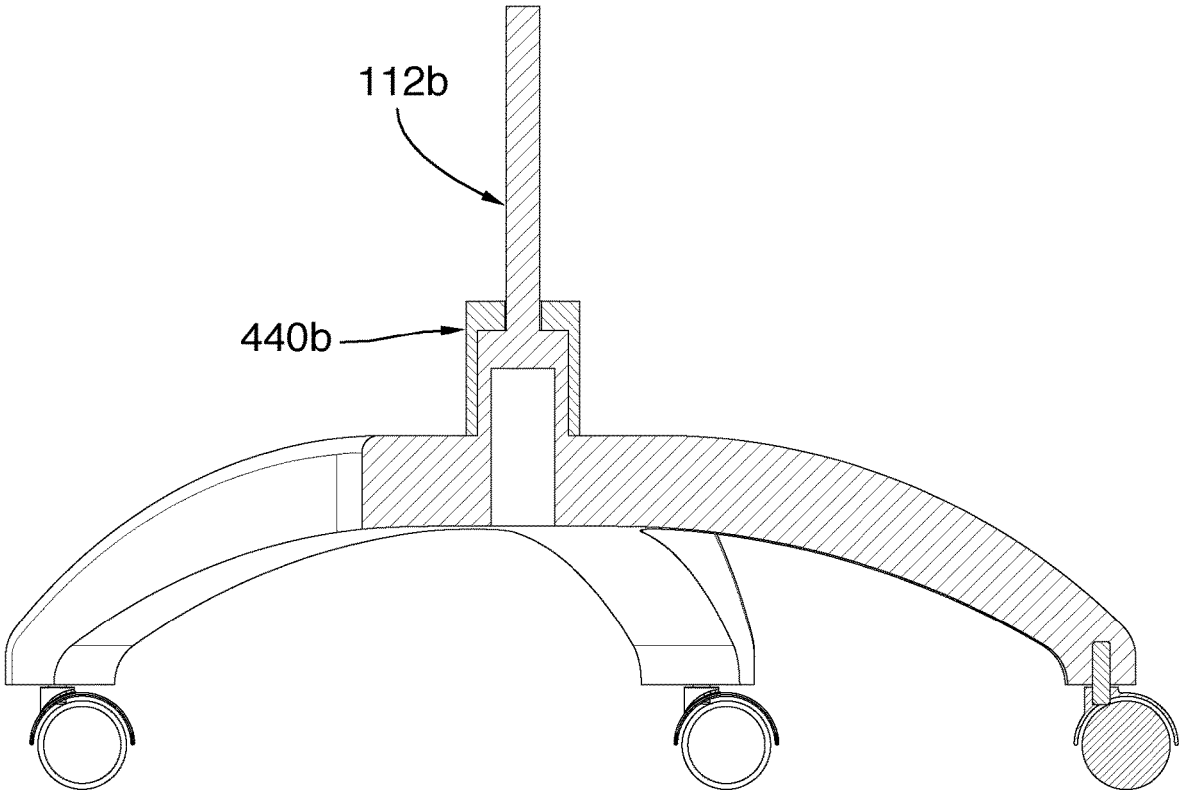
FIG. 27B illustrates a section view of an example embodiment of the system in FIG. 16 for attachment to a chair post with a stepped radius along its axial length.
Figure 27C:
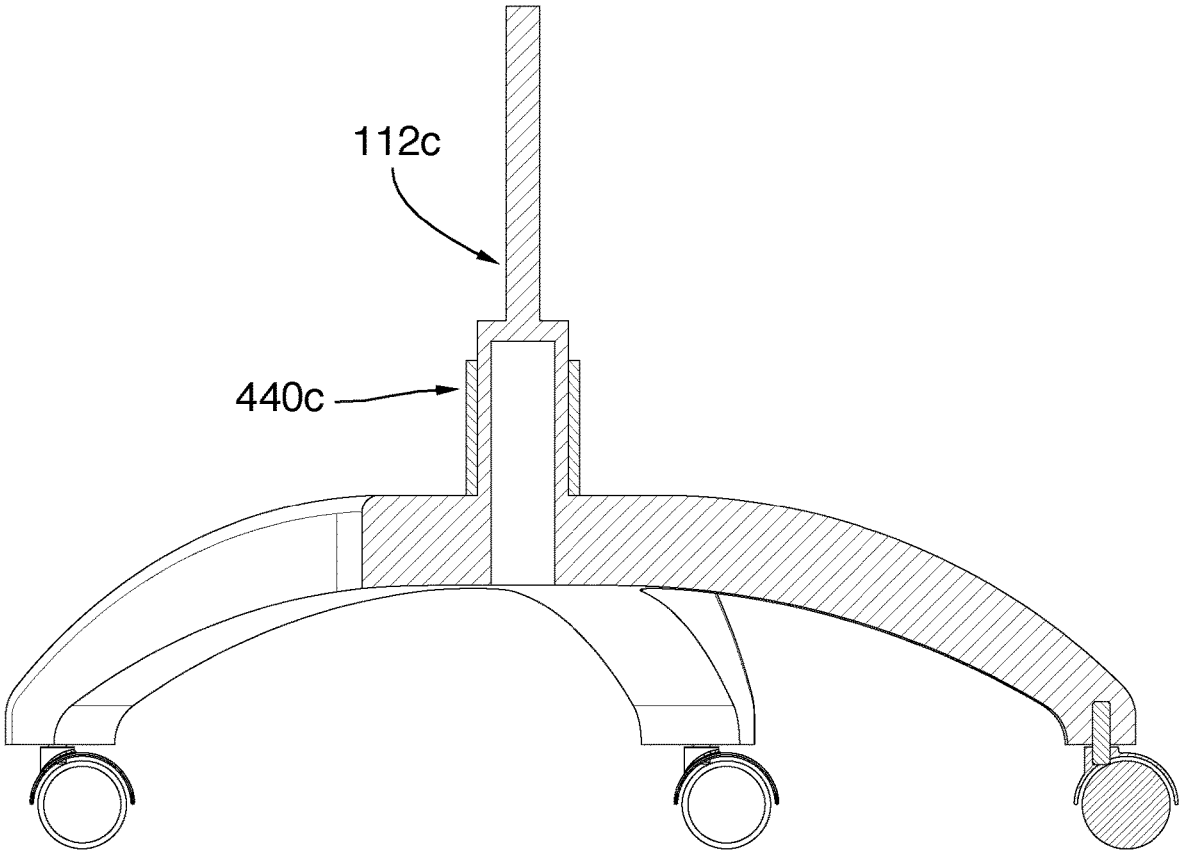
FIG. 27C illustrates a section view of an example embodiment of the system in FIG. 16 for attachment to a chair post with a thick gas strut and a thin collar.

FIGS. 27A, 27B and 27C illustrate a section view of different example embodiments of clamps of the support device 404 for attachment to different central posts 112 of different task chairs 102. FIG. 27A illustrates the central post 112*a* with thin post and thick collar, FIG. 27B illustrates the central post 112*b* with a stepped radius along its axial length, and FIG. 27C illustrates the central post 112*c* with a thick gas strut and a thin collar. The radius of the example clamps applies to both the first clamp part 446 and the second clamp part 448. As shown in FIG. 27A, in an example embodiment, an inner radius of the clamp 440*a* can be dimensioned so as to match the thick collar of the central post 112*a*. As shown in FIG. 27C, in an example embodiment, an inner radius of the clamp 440*c* can be dimensioned so as to match the thick collar of the central post 112*c*.

As shown in FIG. 27B, in an example embodiment, the central post 112*b* can include more than one radius along its axial length, for example thick radius at a lower part and thin radius at a higher part. In an example embodiment, along an axial length or height of the clamp 440*b*, there is more than one interior arc angle each corresponding to a respective one of the radiuses of the central post 112*b*. Accordingly, the clamp 440*b* includes a larger (thicker) radius at a lower part of its height and a smaller (thinner) radius at an upper part of its height. Further radiuses can be implemented in other example embodiments, depending on the dimensions of the central post 112 of the particular task chair 102.

Figure 28:
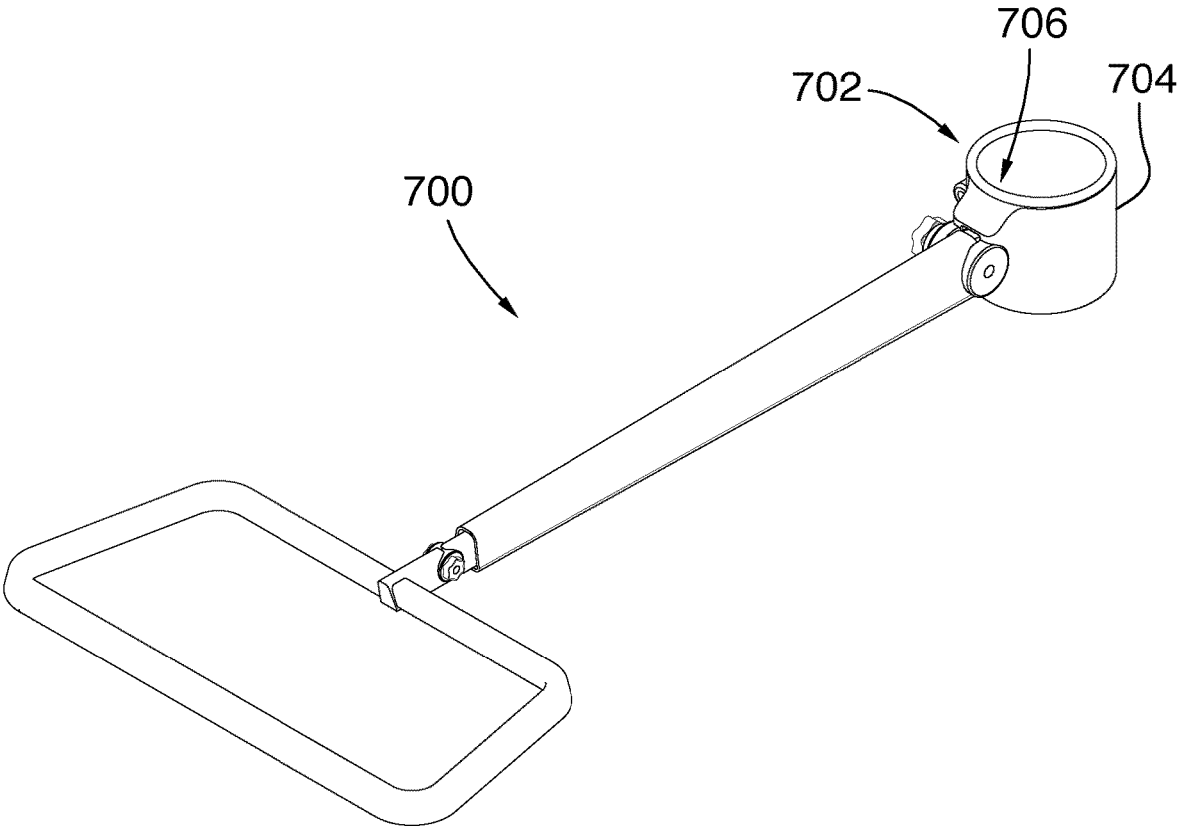
FIG. 28 illustrates a top-front perspective view of another foot and/or leg support device, in accordance with another example embodiment.

FIG. 28 illustrates a top-front perspective view of another foot and/or leg support device 700, in accordance with another example embodiment. The foot and/or leg support device 700 differs from the above-described foot and/or leg support device 400 at the connector 702, which is a cylindrical connector used to mount the support device 700 to the central post 112 of the task chair 102. The connector 702 comprises a cylindrical frame 704 which defines a cylindrical interior surface 706 that is generally circular in axial cross-section. The cylindrical interior surface 706 has a radius of curvature that is substantially equal to the radius of the central post 112 of the task chair 102. In an example embodiment, during assembly, the connector 702 is slid over the central post 112 of the task chair 102, and then the seat 120 is installed on to the central post 112. The connector 702 may be horizontally pivotable around the central post 112 when installed.

In an example embodiment, the support device 700 is installed onto the task chair 102 during assembly of the task chair 102. For example, the connector 702 is looped onto the central post 112 of the task chair 102, and then the seat 120 is installed onto the central post 112.

In another example embodiment, not shown here, the central post 112 may have more than one radius of curvature along its axial length, and the cylindrical interior surface 706 can be shaped accordingly along its axial length.

Figure 29:
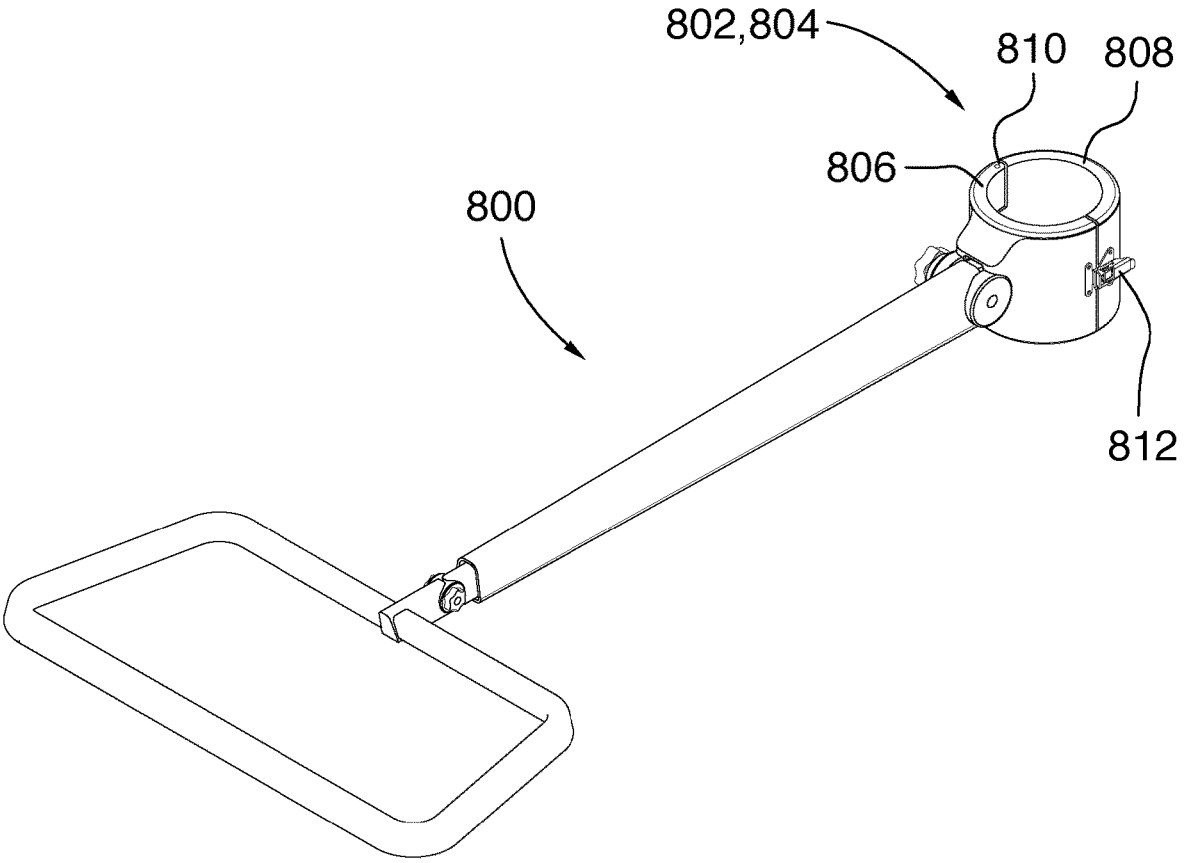
FIG. 29 illustrates a top-front perspective view of another foot and/or leg support device, in accordance with another example embodiment.

FIG. 29 illustrates a top-front perspective view of another foot and/or leg support device 800, in accordance with another example embodiment. The foot and/or leg support device 800 differs from the above-described foot and/or leg support device 400 at the connector 802, which is used to mount the support device 800 to the central post 112 of the task chair 102.

In an example embodiment, the connector 802 comprises a clamp 804 which can include a first clamp part 806 and a second clamp part 808 connected by a hinge 810 at one end, rather than a fastener (bolt) at that end. Each clamp part 806, 808 includes a radius of curvature which is substantially equal to the radius of the central post 112 of the chair 102. When assembled, the clamp parts 806, 808 collectively define an interior cylindrical surface for surrounding the central post 112. A fastener mechanism 812 such as a spring clamp is used to secure one end of the clamp 804 so that the first clamp part 806 is securely fastened to the second clamp part 808. Accordingly, only one fastener mechanism 812 or fastener is required to be used when installing the clamp 440 onto the central post 112, in the example embodiment shown. In the example embodiment shown, each clamp part 806, 808 has an arc angle measure of 180 degrees. In another example embodiment, not shown, the clamp parts 806, 808 do not necessarily have an arc angle measure of 180 degrees, but have different arc angle measures that collectively total 360 degrees.

Figure 30:
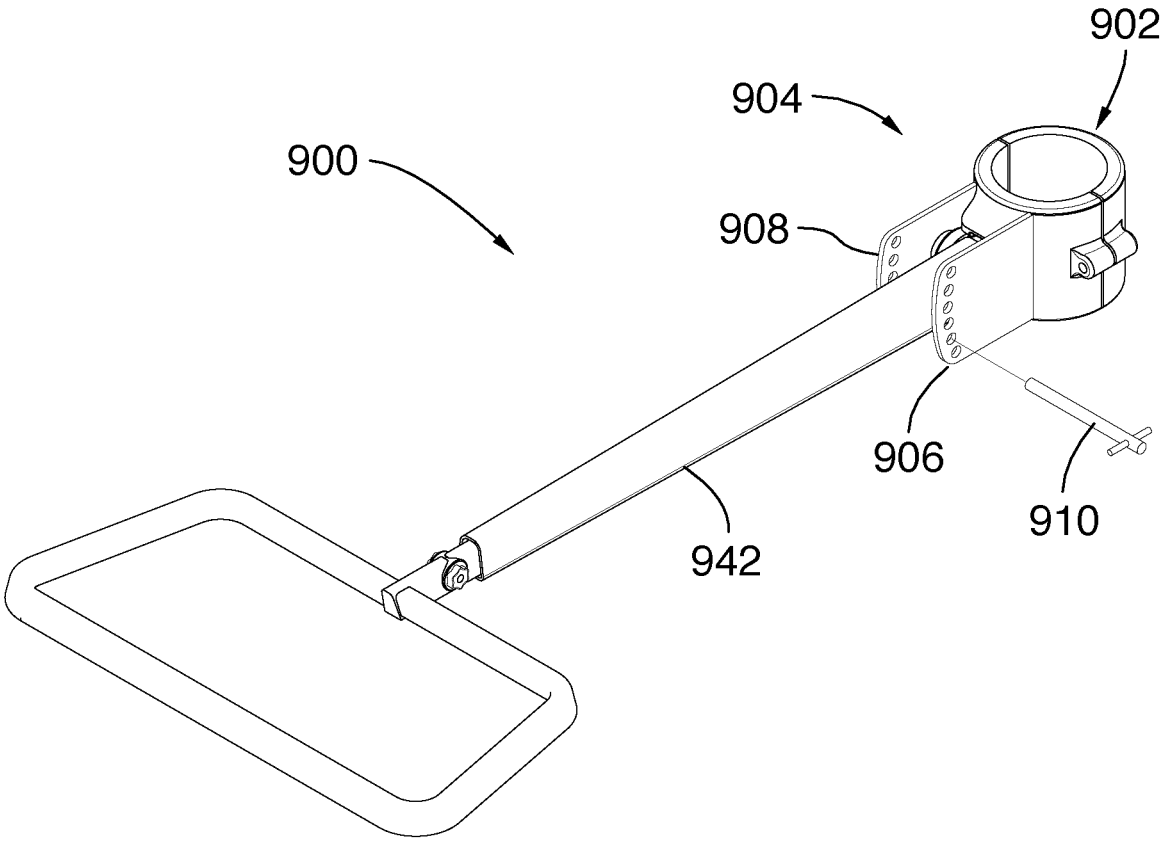
FIG. 30 illustrates a top-front perspective view of another foot and/or leg support device, in accordance with another example embodiment.

FIG. 30 illustrates another example foot and/or leg support device 900, in accordance with another example embodiment. The foot and/or leg support device 900 differs from the above-described foot and/or leg support device 400 by having a vertical angle adjustment bracket 904 at the clamp 902. The vertical angle adjustment bracket 904 allows setting of the vertical angle of the cantilever arm 942. The vertical angle adjustment bracket 904 is connected to the clamp 902. The vertical angle adjustment bracket 904 includes a first bracket 906 and second bracket 908, each defining a plurality of apertures or holes. The holes are positioned at different vertical angle positions, with respect to the axis of rotation of the arm 942. The holes can receive a pin 910 at a selected vertical operating angle of the arm 942. When the pin 910 is inserted through the holes of the brackets 906, 908, the arm 942 can rest on top of the pin 910. Therefore, the arm 942 is restricted from rotating in any further downward vertical angles due to the presence of the pin 910. The pin 910 therefore supports applicable loads from the feet of the user. The arm 942 can move freely in the upward vertical angle direction. For example, the user can lift the arm 942 from the pin 910 with their foot, and horizontally pivot the arm 942 around other obstacles such as the chair support legs 116, and drop the arm 942 back onto the pin 910. In another example embodiment, not shown, the arm 942 itself may also define through-hole(s) which can also receive the inserted pin 910, providing locking of the selected vertical angle of the arm 942.

In another example embodiment, a bolt or screw can be used instead of the pin 910, and can be screwed into applicable holes or attached using a bolt, for example.

In some example embodiments, suitable materials for at least some or all of the described component parts can be a rigid and light material, including plastic, nylon, stainless steel, metal, aluminum, and/or carbon fiber, for example.

In an example embodiment, there is provided a kit of parts containing components of the system(s) described herein, and suitable instructions for assembly thereof.

Variations may be made to some example embodiments, which may include combinations and sub-combinations of any of the above. The various embodiments presented above are merely examples and are in no way meant to limit the scope of this disclosure. Variations of the example embodiments described herein will be apparent to persons of ordinary skill in the art, such variations being within the intended scope of the present disclosure. In particular, features from one or more of the above-described embodiments may be selected to create alternative embodiments comprised of a sub-combination of features which may not be explicitly described above. In addition, features from one or more of the above-described embodiments may be selected and combined to create alternative embodiments comprised of a combination of features which may not be explicitly described above. Features suitable for such combinations and sub-combinations would be readily apparent to persons skilled in the art upon review of the present disclosure as a whole. The subject matter described herein intends to cover and embrace all suitable changes in technology.

Certain adaptations and modifications of the described embodiments can be made. Therefore, the above discussed embodiments are considered to be illustrative and not restrictive.

What is claimed is:

1. A foot and/or leg support device for a chair, the chair including a central post having a radius and having a base, a seat supported by the central post and having a front seat edge, and a plurality of support legs which branch from the base of the central post, the support device comprising:

a connector for attachment to the central post of the chair, wherein the connector comprises a circular interior having a radius of curvature substantially equal to the radius of the central post of the chair;

exactly one cantilever arm which extends from the connector;

a pivot which connects the cantilever arm to the connector, the pivot being configured for vertical pivoting; and a support frame located at a distal end of the cantilever arm for supporting a foot and/or leg of a user, the cantilever arm being a length wherein at least part of the support frame extends past a vertical plane of the front seat edge of the seat of the chair.

2. The support device as claimed in claim 1, further comprising a lock for tightening and loosening of the pivot.

3. The support device as claimed in claim 1, further comprising a second pivot which connects the cantilever arm to the support frame, the second pivot being configured for vertical pivoting.

4. The support device as claimed in claim 3, further comprising a second lock for tightening and loosening of the second pivot.

5. The support device as claimed in claim 1, wherein the pivot is a hinge configured for only vertical pivoting.

6. The support device as claimed in claim 1, wherein the connector comprises a clamp.

7. The support device as claimed in claim 6, wherein the clamp comprises a first clamp part and a second clamp part, the first and second clamp parts each comprise an interior arc, wherein the respective interior arc of each of the first and second clamp parts have a radius of curvature equal to the radius of the central post of the chair.

8. The support device as claimed in claim 7, wherein the clamp further comprises at least one fastener for loosening and tightening of the clamp.

9. The support device as claimed in claim 7, wherein the clamp further comprises a hinge which connects the first clamp part to the second clamp part at one side of the clamp, and a fastener for fastening the first clamp part to the second clamp part at another side of the clamp.

10. The support device as claimed in claim 1, wherein the central post includes more than one radius along its axial length, wherein along an axial length of the connector is more than radius of curvature each corresponding to a respective one of the radiuses of the central post.

11. The support device as claimed in claim 1, wherein the support frame extends past a circumference defined by distal ends of the plurality of support legs.

12. The support device as claimed in claim 1, further comprising an extension mechanism to further extend the support frame from the connector to an extended configuration.

13. The support device as claimed in claim 12, wherein the cantilever arm comprises at least part of the extension mechanism, wherein the extension mechanism comprises a first telescopic member and a second telescopic member, wherein the first telescopic member is slideable with respect to the second telescopic member to adjust the support frame to the extended configuration.

14. The support device as claimed in claim 13, wherein the first telescopic member and/or the second telescopic member comprise one or more adjustment holes, wherein the extension mechanism further comprises an adjustment fastener for insertion within the one or more adjustment holes to maintain the relative position of the first telescopic member and the second telescopic member.

15. The support device as claimed in claim 14, wherein the adjustment fastener for the telescopic members comprises a spring loaded plunger, a resilient push button, a screw, a bolt, or a pin.

16. The support device as claimed in claim 1, wherein the support frame comprises the extension mechanism, further comprising at least one hinge which connects the support frame to the distal end of the cantilever arm, to adjust the support frame to the extended configuration.

17. The support device as claimed in claim 1, further comprising a removable tray for installation onto the support frame.

18. The support device as claimed in claim 17, wherein the removable tray comprises a first tray part for installation onto the support frame, a hinge, and a second tray part hingedly connected to the first tray part by way of the hinge.

19. A foot and/or leg support assembly system, comprising:

the foot and/or leg support device as claimed in claim 1; and the chair.

20. The assembly system as claimed in claim 19, wherein the base of the chair includes a connection point between the plurality of support legs and the central post, wherein the clamp is installed on the central post on or above the connection point.

21. The assembly system as claimed in claim 19, wherein the base of the chair includes a connection point between the plurality of support legs and the central post, wherein the clamp is installed on the central post below the connection point and extends between two of the support legs.

22. A use of the foot and/or leg support device as claimed in claim 1, comprising clamping the foot and/or leg support device to the chair without disassembling the chair.

* * * * *